US012534278B2

(12) United States Patent
Nelson et al.

(10) Patent No.: US 12,534,278 B2
(45) Date of Patent: Jan. 27, 2026

(54) SINGLE USE CAP

(71) Applicant: Quest Medical, Inc., Allen, TX (US)

(72) Inventors: Andrew Nelson, Dallas, TX (US); James Bernal, Frisco, TX (US); Jeffrey Albertsen, McKinney, TX (US); Robert Mart, Colleyville, TX (US)

(73) Assignee: Quest Medical, Inc., Allen, TX (US)

( * ) Notice: Subject to any disclaimer, the term of this patent is extended or adjusted under 35 U.S.C. 154(b) by 27 days.

(21) Appl. No.: 18/400,456

(22) Filed: Dec. 29, 2023

(65) Prior Publication Data

US 2024/0217714 A1 Jul. 4, 2024

Related U.S. Application Data

(60) Provisional application No. 63/522,548, filed on Jun. 22, 2023, provisional application No. 63/436,033, filed on Dec. 29, 2022.

(51) Int. Cl.

| | |
|---|---|
| ***B65D 55/08*** | (2006.01) |
| ***B65D 39/10*** | (2006.01) |
| ***B65D 41/06*** | (2006.01) |
| ***B65D 45/32*** | (2006.01) |
| *B65D 1/02* | (2006.01) |

(52) U.S. Cl.

CPC ..... *B65D 55/0872* (2013.01); *B65D 39/10* (2013.01); *B65D 41/06* (2013.01); *B65D 45/325* (2013.01); *B65D 1/0246* (2013.01)

(58) Field of Classification Search

CPC .... B65D 55/0872; B65D 39/10; B65D 41/06; B65D 45/325; B65D 1/0246

USPC ..... 215/238, 258, 263

See application file for complete search history.

(56) References Cited

U.S. PATENT DOCUMENTS 3,514,003 A * 5/1970 Fitzgerald ..... B65D 50/06 215/221
3,630,403 A * 12/1971 Berg ..... B65D 50/064 215/221
5,902,298 A 5/1999 Niedospial, Jr. et al.

(Continued)

FOREIGN PATENT DOCUMENTS

DE 102006019550 A1 * 10/2007 ..... B65D 39/0064
KR 20120106500 A * 9/2012

(Continued)

*Primary Examiner* — Orlando E Aviles
*Assistant Examiner* — Niki M Eloshway
(74) *Attorney, Agent, or Firm* — Stephen Y. Liu; James H. Ortega; Carstens, Allen & Gourley, LLP

(57) ABSTRACT

The disclosed principles provide for single use caps that may be applied to any of a number of receptacles, containers, vessels, needless connectors, or other device. A single use cap as disclosed herein includes a component that, when the cap is threaded onto a receptacle or device, is moved from an "unused" to a "used" position by the twisting force applied to the cap when secured onto the receptacle or device. Specifically, once the threads of the receptacle or device are received into the cap and a twisting or tightening force is continued to be applied to the cap, the continued twisting force causes this component to rotate laterally so that once the cap is removed from the receptacle or device, the threads of the cap are no longer reachable by the threads on the receptacle or device.

20 Claims, 23 Drawing Sheets

(56) References Cited

U.S. PATENT DOCUMENTS

| | | | | |
|---|---|---|---|---|
| 5,921,419 | A | 7/1999 | Niedospial, Jr. et al. | |
| 5,944,207 | A * | 8/1999 | Reidenbach | B65D 41/0471 215/237 |
| 8,453,859 | B2 * | 6/2013 | Rozenberg | B65D 41/3457 215/258 |
| 2005/0119521 | A1 | 6/2005 | Pitcher | |
| 2009/0250469 | A1 * | 10/2009 | Heiberger | B65D 47/242 215/44 |
| 2012/0055900 | A1 * | 3/2012 | De Rosa | B65D 47/2087 215/258 |
| 2016/0143647 | A1 | 5/2016 | Gavriely et al. | |
| 2021/0322752 | A1 | 10/2021 | Jiang et al. | |
| 2021/0346672 | A1 | 11/2021 | Grant et al. | |
| 2023/0173245 | A1 | 6/2023 | Albertsen et al. | |

FOREIGN PATENT DOCUMENTS

| | | | | |
|---|---|---|---|---|
| WO | WO-2006000775 | A1 * | 1/2006 | B65D 41/06 |
| WO | WO-2006000778 | A1 * | 1/2006 | B65D 41/06 |

* cited by examiner

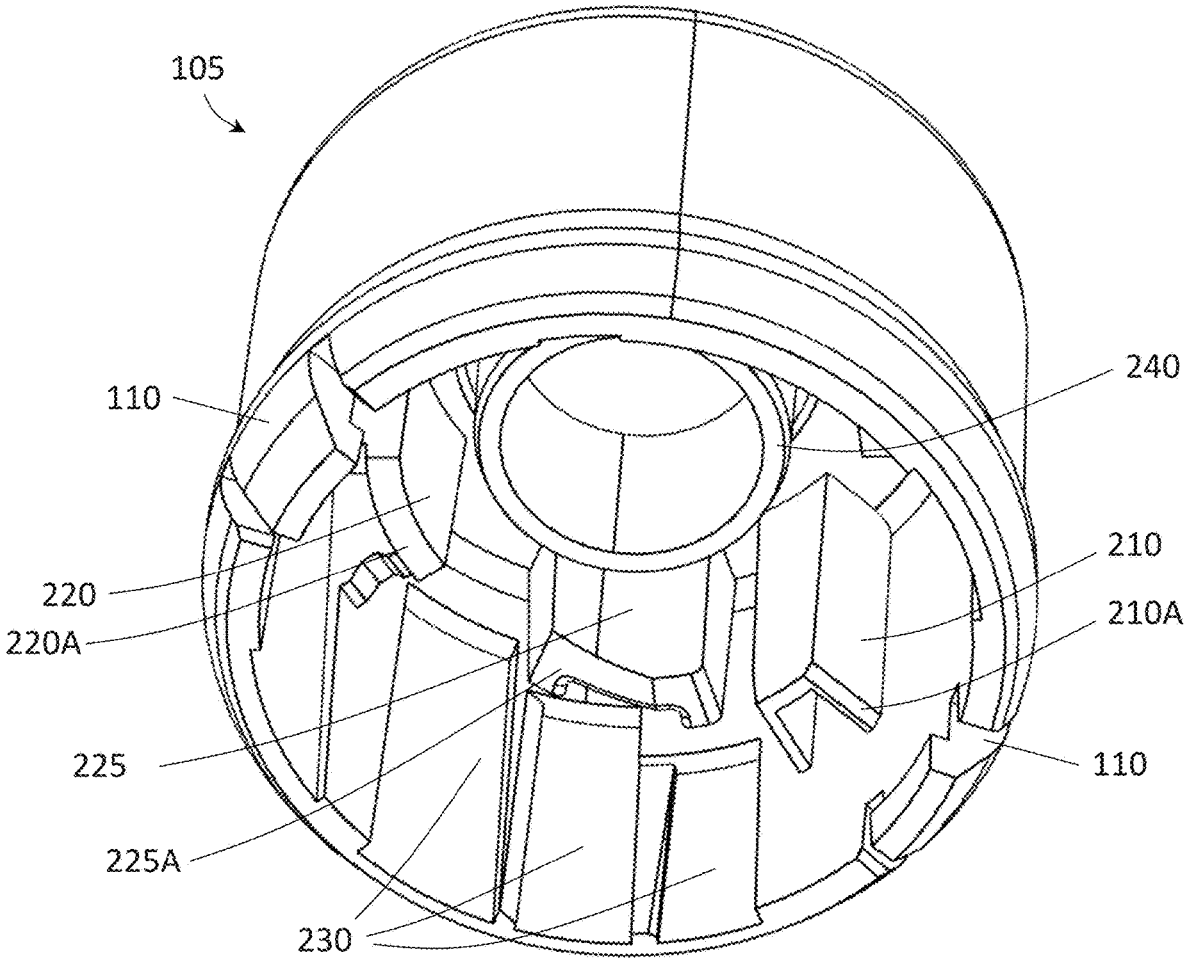
FIG. 3
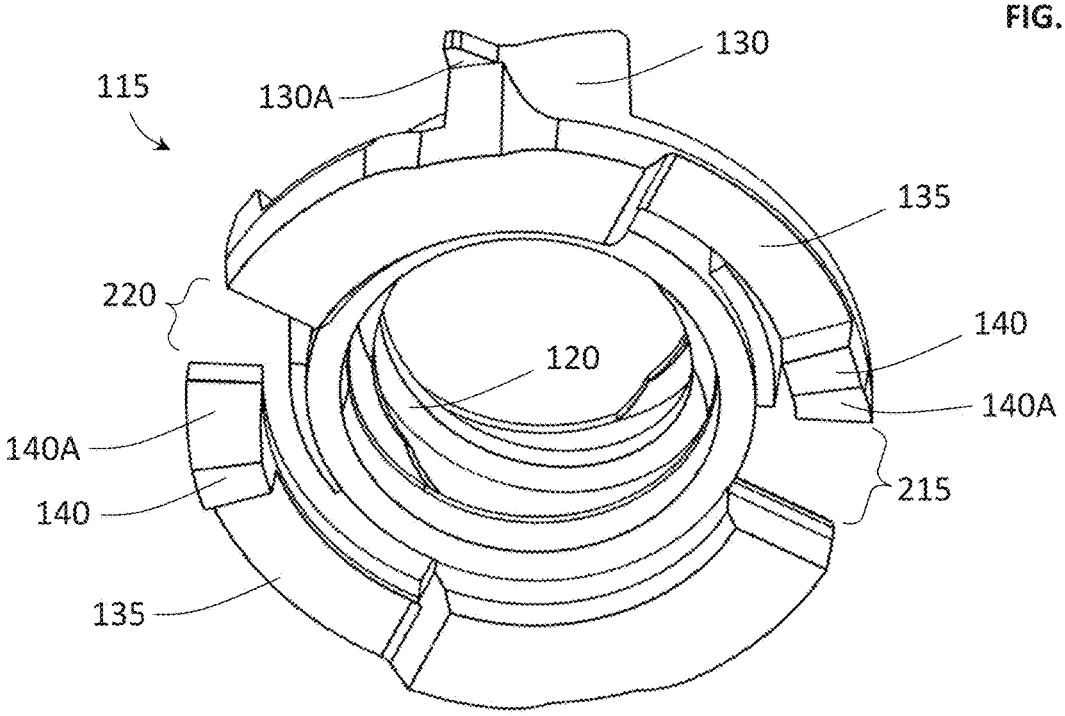

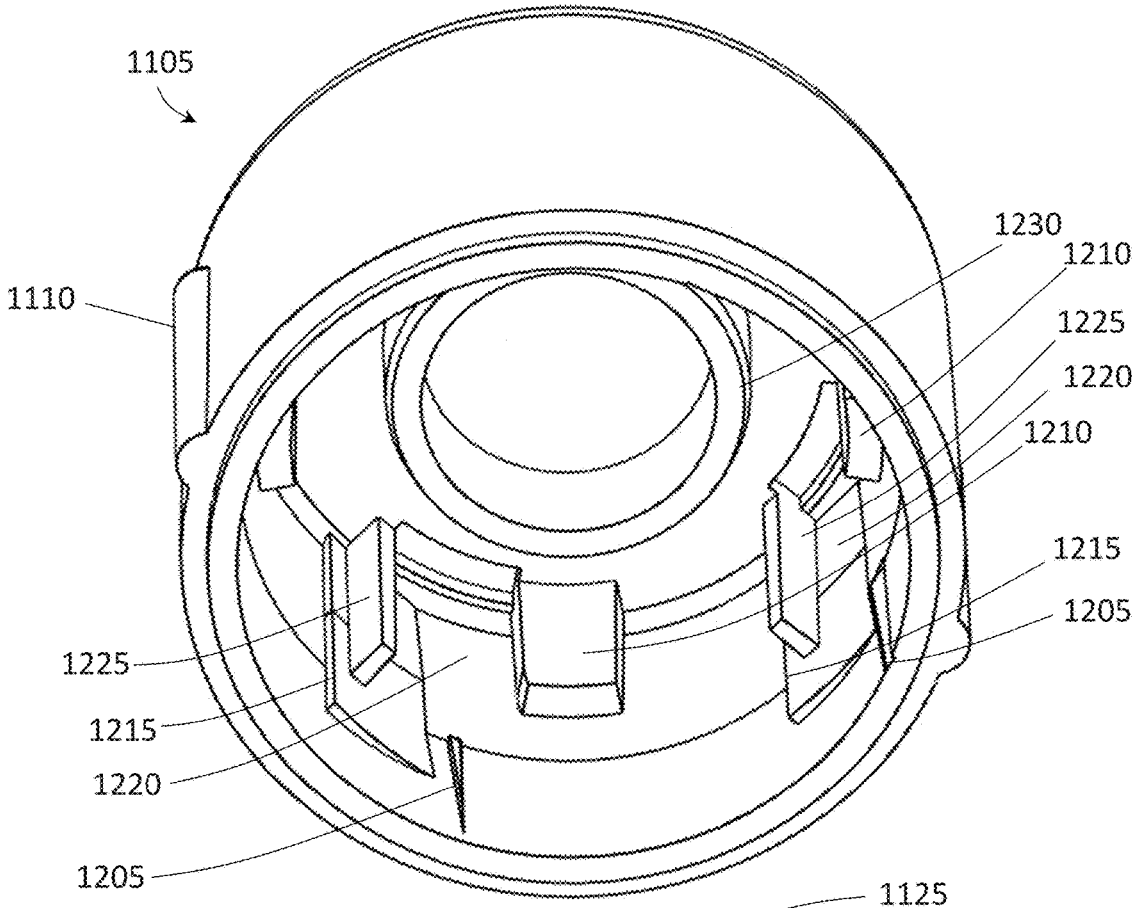
FIG. 10
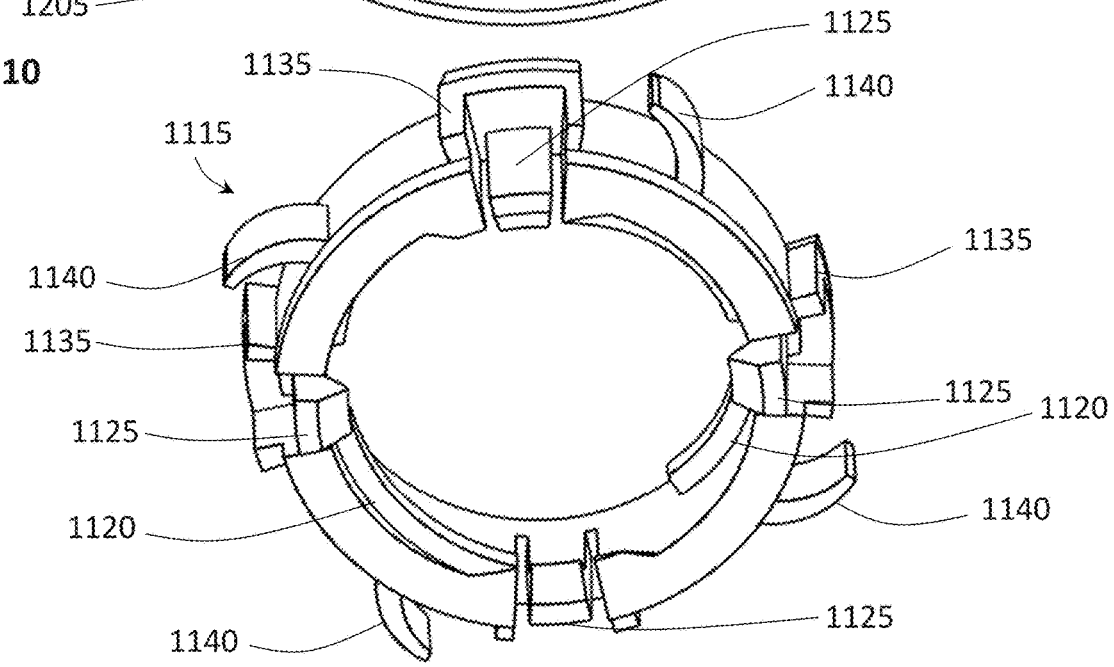

SINGLE USE CAP

RELATED APPLICATIONS

This disclosure claims priority to U.S. Provisional Patent Application Ser. No. 63/436,033, filed Dec. 29, 2022, and U.S. Provisional Patent Application Ser. No. 63/522,548, filed Jun. 22, 2023, the disclosures of which are hereby incorporated by reference in their entireties for all purposes.

TECHNICAL FIELD

This disclosure relates to the field of caps for needless connectors, and more particularly to novel single use caps, methods of use and methods of manufacture thereof.

BACKGROUND

Numerous receptacles, containers, vessels, and in particular needless connectors include threaded openings configured to receive a sealing threaded cap thereon. In particular, medical and other sterile embodiments of receptacles, containers, vessels, and devices can include containers with medications and IV connections and devices such as needless connectors for IV lines. These receptacles and devices necessarily required caps that provide seals sufficient to prevent leakage or contamination of the receptacle and its contents or the device and its sterilized surfaces. Critically, once such sterile receptacles or devices are uncapped, they should not be recapped with their originally sealed cap, since doing so can introduce contaminants onto and/or in the receptacle or device.

Accordingly, what is needed in the art is a cap for use on receptacle and devices that cannot be rethreaded on those items once they have been unscrewed and removed from them. However, conventional designs and approaches for such caps typically involve designs that require excess manufacturing costs. As a result, many conventional offerings tend to be overly simplified in an effort to reduce such costs; however, such simple caps become de-featured and thus provide less options for securely preventing reuse of caps. The disclosed principles provide unique single use caps, methods of use, and methods of manufacture thereof that do not suffer from the deficiencies found in conventional approaches.

SUMMARY

The disclosed principles provide for single use caps that may be applied to any of a number of receptacles, containers, vessels, or other device. For example, a single use cap as disclosed herein may be used with a needless connector or other similar medical components, which are typically used with IVs or other medical procedures. Such disclosed caps are "single use" in that once it has been threaded onto a receptacle or other device and then thereafter removed, the same cap cannot thereafter be re-threaded onto the receptacle or device. A single use cap as disclosed herein includes a component that, when the cap is threaded onto a receptacle or device, is moved from an "unused" to a "used" position by the twisting force applied to the cap when secured onto the receptacle or device. Specifically, once the threads of the receptacle or device are received into the cap and a twisting or tightening force is continued to be applied to the cap, the continued twisting force causes this threaded component to move upwards into the cap so that once the cap is removed from the receptacle or device, the threads of the cap are no longer accessible by the threads on the receptacle or device.

In one aspect, the disclosed principles provide a single use cap that comprises a cap body having a top, a bottom, and a hollow interior therebetween accessible through an opening in the bottom of the cap body, and a cap base coupled at the bottom of the cap body and comprising an opening configured to receive a neck of the receptacle therethrough, wherein an interior face of the cap base is configured to be received within the opening of the cap body. In such embodiments, the single use cap further comprises a threaded component configured to be movably received within the hollow interior, and comprising an opening with threads, the threads configured to receive threads on the neck of the receptacle. When the threaded component is in an unused position, the threaded component is positioned proximate the bottom of the cap body such that the threads of the threaded component are reachable by the threads on the neck of the receptacle. And when the threaded component is in a used position, the threaded component is prevented from rotating in either direction but is freely movable vertically within the hollow interior of the cap body such that the threads of the threaded component are not reachable by the threads on the neck of the receptacle when a distal end of said neck contacts the threaded component.

In another aspect, the disclosed principles provide a single use cap for a receptacle that comprises a cap body having a top, a bottom, and a hollow interior therebetween accessible through an opening in the bottom of the cap body, and a cap base coupled at the bottom of the cap body and comprising an opening therethrough about an axis of rotation of the cap base. Such single use caps may also comprise a threaded component configured to be movably received within the hollow interior, and comprising an opening with threads concentric with the opening of the cap base, the threads configured to receive threads on a neck of the receptacle. In such embodiments, the threaded component is configured to rotate with respect to the cap base about the axis of rotation from an unused position, where the threads of the threaded component are reachable by the threads on the neck of the receptacle, to a used position, where the threaded component is freely movable vertically within the cap body such that the threads of the threaded component are not reachable by the threads on the neck of the receptacle when a distal end of said neck contacts the threaded component. Further, the threaded component in such single use caps may comprise one or more features, where each is configured to prevent rotation of the threaded component in a direction corresponding to a tightening rotational direction of the threads of the threaded component when the threaded component is in the unused position, and prevent rotation of the threaded component in either the direction corresponding to a tightening rotational direction of the threads of the threaded component or a loosening rotational direction of the threads of the threaded component when the threaded component is in the used position.

Additional embodiments and advantages and variation thereof are also encompassed within the scope of the disclosed principles, and some such exemplary embodiments discussed in further detail herein.

BRIEF DESCRIPTION OF THE DRAWINGS

The novel features believed characteristic of the disclosure are set forth in the appended claims. The disclosure itself, however, as well as a preferred mode of use, further objectives, and advantages thereof, will be best understood by reference to the following detailed description of illustrative embodiments when read in conjunction with the accompanying drawing, in which:

FIG. 3 illustrates a partial exploded view of just the cap body and the threaded component illustrated in FIGS. 1 and 2;

FIG. 10 illustrates a partial exploded view of just the cap body and the threaded component illustrated in FIG. 1;

DETAILED DESCRIPTION

Figure 1:
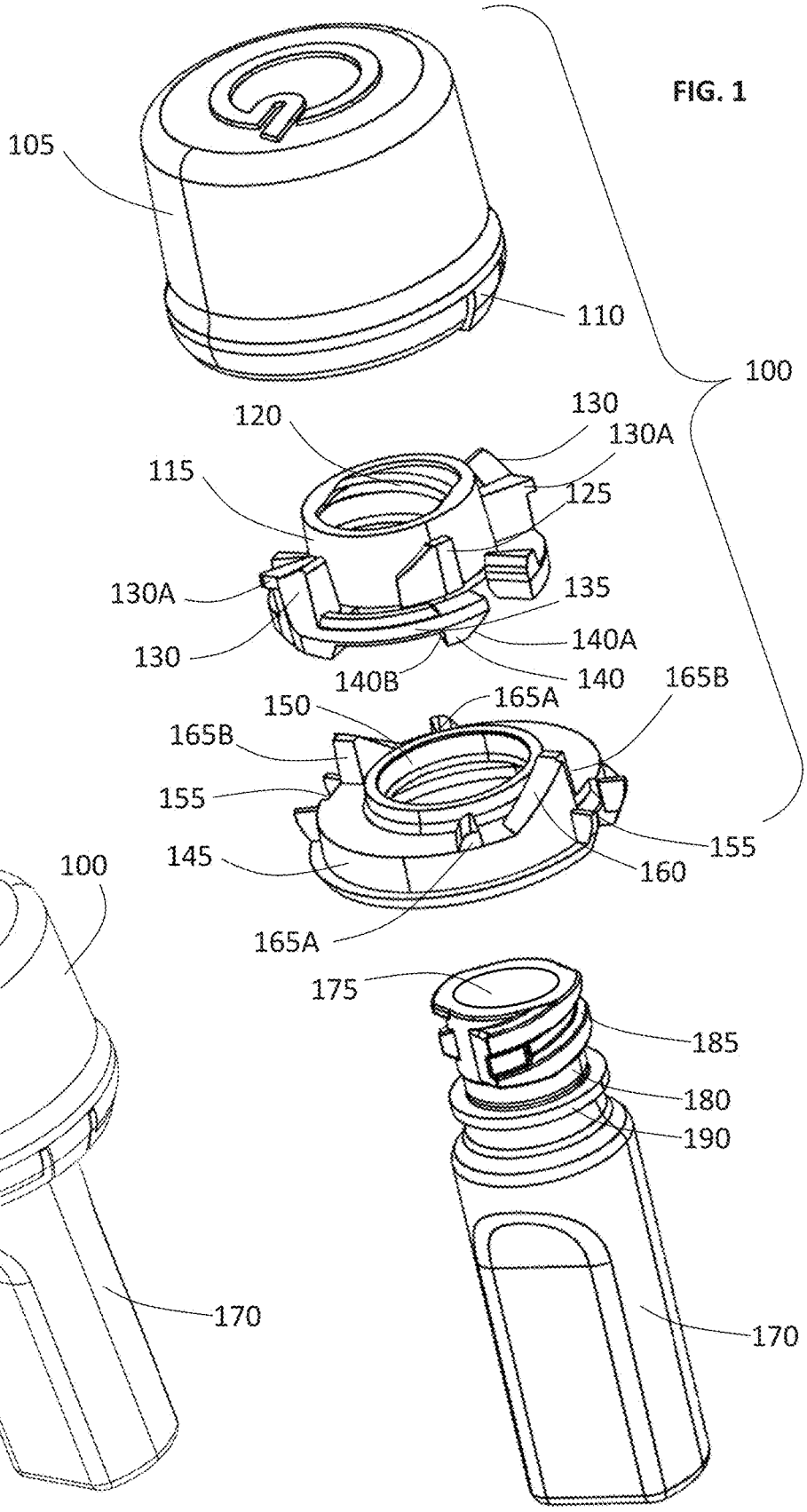
FIG. 1 illustrates an exploded view of one embodiment of a single use cap designed and constructed in accordance with the disclosed principles.

For the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates. Although multiple embodiments are shown and discussed in great detail, it will be apparent to those skilled in the relevant art that some features that are not relevant to the present invention may not be shown for the sake of clarity.

Looking initially at FIG. 1, illustrated is an exploded view of one embodiment of a single use cap 100 designed and constructed in accordance with the disclosed principles. This embodiment of the single use cap 100 comprises three components, a cap body 105, an intermediate threaded component 115, and a cap base 145. However, in other embodiments two or more components may be combined into a single unitary component or the addition of a separate (e.g., expandable) member that would translate the threaded component from an unused to a used state.

The cap body 105 defines a hollow interior (see FIG. 2) designed and configured to receive the threaded component 115 and the cap base 145. The cap body 105 also includes a bottom portion that comprises one or more fasteners 110 configured to attach the cap body 105 to the cap base 145 via corresponding fastener receivers 155. In the illustrated embodiment, the cap body 105 includes two fasteners 110 oriented at 180 degrees apart and configured to attach to two respective fastener receivers 155 formed on the cap base 145. When attached, the cap body 105 and cap base 145 function as a single piece, wherein the threaded component 115 is movable within the hollow interior of the cap body 105 in the manner described in detail below. In alternative embodiments, a single use cap as disclosed herein may not include such fasteners and corresponding receivers, and instead the cap body 105 and the cap base 145 may be joined together in any of a number of various ways, including adhering, welding, or otherwise bonding the two components.

The threaded component 115 includes an opening through its center which features threads 120 for receiving the threaded end of a receptacle or other vessel 170 onto which the single use cap 100 will be secured. The cap base 145 also includes a central opening 150 that is concentric with the opening in the threaded component 115; however, the opening 150 in the cap base 145 is sized to be larger than the threads 120 in the threaded component 115 so that the threaded end of the receptacle 170 can pass through the cap base 145 unobstructed. The openings of the threaded component 115 and the cap base 145 are concentric, and both components are rotatable about an axis of rotation at the center of their openings.

The threaded component 115 comprises a plurality of features that correspond to features formed on the cap base 145. Both cap body 105 and cap base 145 contain features, which when assembled form in the hollow interior of the cap body 105 the single use functionality of the single use cap 100. Among these features on the threaded component 115 in this illustrated embodiment are one or more interior cams 125 located around a central core of the threaded component 115 through which the opening and threads 120 are defined. Also among these features are one or more exterior cams 130 located at an outer perimeter of the threaded component 115. Both the interior and exterior cams 125, 130 cooperate with respective features formed in the hollow interior of the cap to align and orient the threaded component 115, as described in further detail below. Also, secondary locking features 130A, discussed in additional detail below, may be provided adjacent corresponding one or more exterior cams 130.

The threaded component 115 also includes at least one arm 135 formed at the perimeter of the threaded component 115. In this embodiment, the proximal end of arm 135 is located such that it extends from the exterior cam 130; however, other locations for the arm(s) 135 are also possible. The distal end of each arm 135 includes at least one lifting element that assists in lifting the threaded component 115 upwards within the cap body 105 during use. In the illustrated embodiment, the lifting element is a clipping element 140 downwardly formed and extending from that distal end. As illustrated, a leading edge 140A of this clipping element 140 may comprise a slope for engaging a corresponding at least one positioning feature 160 formed on the cap base 145. In this illustrated embodiment, the positioning features 160 is a sloped feature 160. In addition, a trailing edge of the clipping element 140 includes a locking surface 140B configured to engage a corresponding first engaging surface 165A on the cap base 145 when the threaded component 115 is in a starting position with respect to the cap base 145, and a second engaging surface 165B when the threaded component 115 is in a finishing position with respect to the cap base 145. The interaction of these various components will be discussed in greater detail below.

Figure 1A:
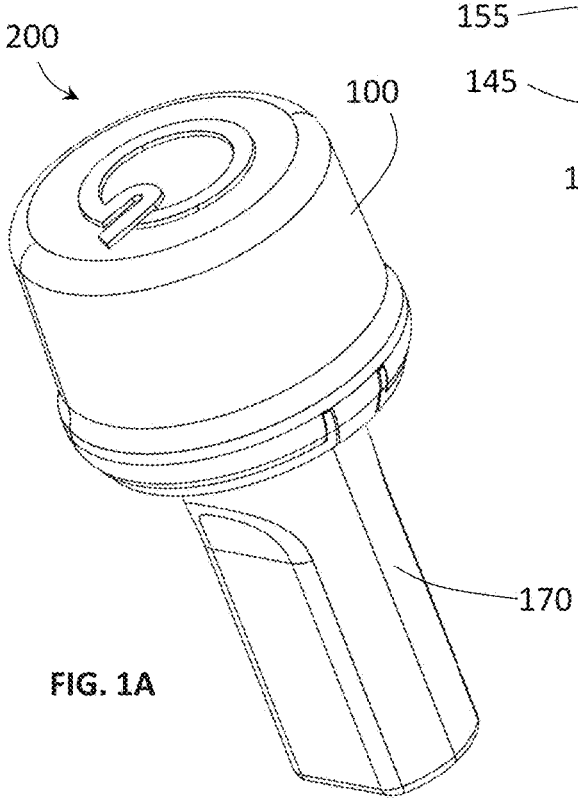
FIG. 1A illustrates an isometric view of an assembly of the embodiment of the single use cap illustrated in FIG. 1 threaded onto a receptacle.

Also illustrated in FIG. 1 is a receptacle or vessel 170 onto which the single use cap 100 may be affixed. In this illustrated embodiment, the receptacle 170 is embodied as a needless connector 170, which may be used for any of a number of medical procedures, such as IV solutions, catheters, and similar applications. In other embodiments, the receptacle 170 may also be any type of container, depending on the application. The illustrated receptacle 170 includes a neck 180 having an opening 175, and threads 185 formed at a distal end of the neck 180. At a proximal end of the neck is a shoulder 190 against which a shoulder of the cap base 145 (see FIG. 2) rests when the cap 100 is threaded onto the receptacle 170. FIG. 1A illustrates an isometric view of an assembly 200 of the embodiment of the single use cap 100 illustrated in FIG. 1 threaded onto the receptacle 170.

Figure 2:
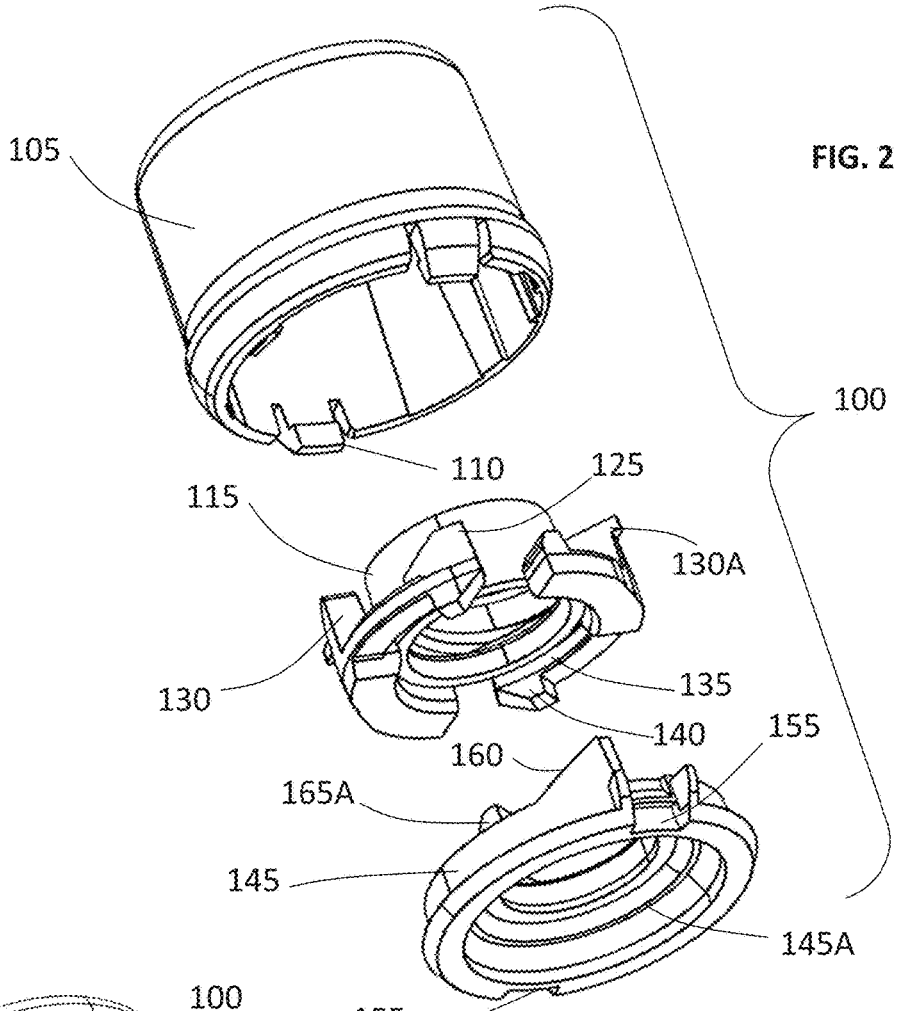
FIG. 2 illustrates an alternate exploded view of the single use cap illustrated in FIG. 1.
Figure 2A:
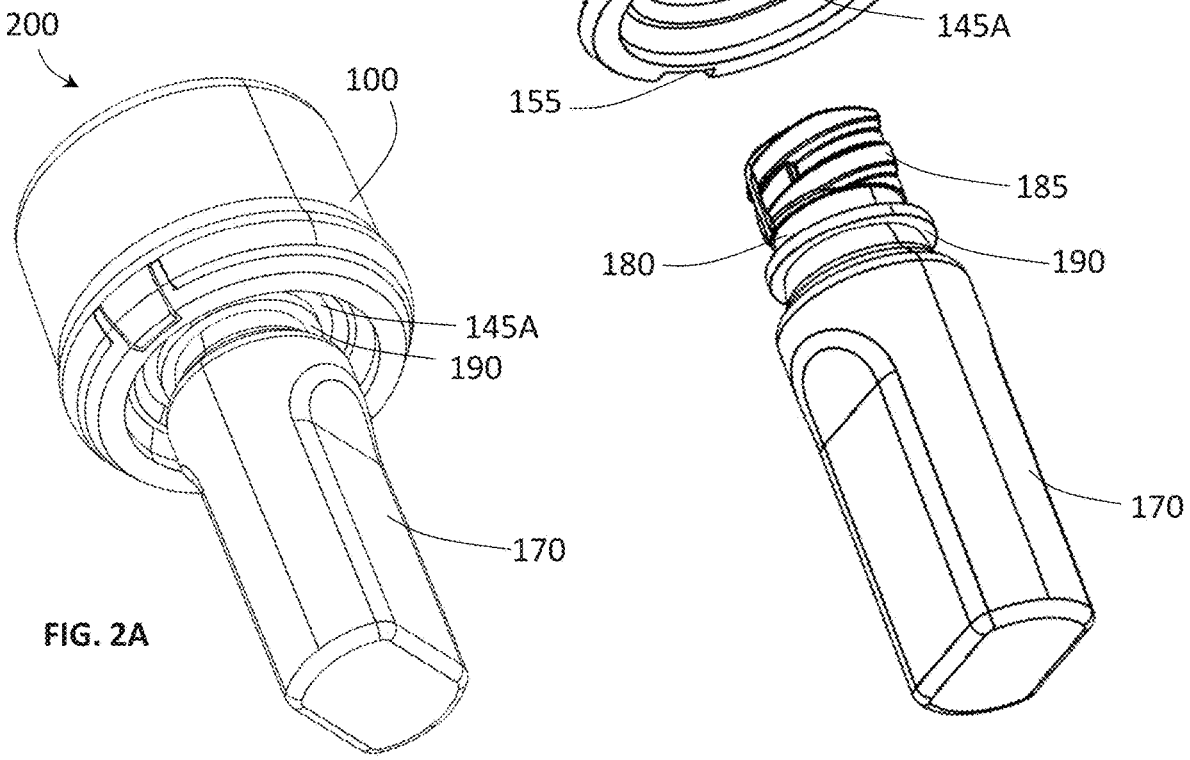
FIG. 2A illustrates an alternate isometric view of the assembly 200 illustrated in FIG. 2 of the single use cap threaded onto the receptacle.

Looking briefly at FIG. 2, illustrated is an alternate exploded view of the single use cap 100 illustrated in FIG. 1. The three components of a cap body 105, an intermediate threaded component 115, and a cap base 145 are again shown, as well as a receptacle to which the single use cap 100 may be attached. Alternate views of the various components of each of these components of the single use cap 100 are visible in this alternate exploded view. Additionally, now visible in FIG. 2 is a shoulder 145A formed inwardly at the base of the central opening 150 of the cap base 145. Specifically, the shoulder 145A of the cap base 145 is sized such that the threads 185 on the neck 180 of the receptacle 170, needless connector, or other component pass unobstructed through the shoulder 145A, but a shoulder 190 formed at the base of the neck 180 does not base the shoulder 145A of the cap base 145. Thus, the threaded component 115 threads down the threads 185 on the neck 180 of the receptacle 170 until no further threads remain and the shoulder 190 of the component 170 bottoms out against the shoulder 145A of the cap base 145. FIG. 2A illustrates an alternate isometric view of the assembly 200 illustrated in FIG. 2 of the single use cap 100 threaded onto the receptacle 170.

Turning now to FIG. 3, illustrated is a partial exploded view of just the cap body 105 and the threaded component 115 illustrated in FIGS. 1 and 2. From this underside view, the hollow interior of the cap body 105 may be seen. When the single use cap 100 is assembled, the threaded component 115 is positioned within this hollow interior. More specifically, the threaded component 115 is maintained in a first position prior to the single use cap 100 being tightened onto a receptacle or vessel, and then maintained in a second position after it has been used on the receptacle.

Formed into the interior of the cap body 105 are several features that cooperate with either or both of the threaded component 115 and cap base 145 to provide the unique functionality of the disclosed principles. For example, the fasteners 110 provided on the base of the cap body 105 are configured to fasten the cap body 105 to the cap base 145, as mentioned above, so that the cap body 105 and cap base 145 may be moved as a single unit with the threaded component 115 held within the cap body 105. Among the features formed in the interior of the cap body 105 that work to align, orient, and locate the threaded component 115 are a locking pin 210 which includes a bottom end 210A that contacts a top surface of the threaded component 115 between the sloped surface 160 and the first engaging surface 165A when the threaded component 115 is in its initial position prior to the single use cap 100 being threaded onto a receptacle. Once the cap 100 is threaded onto a receptacle, the threaded component 115 slides further toward the top of the interior of the cap body 105, and the locking pin 210 slides into a corresponding locking slot 215 on the threaded component 115. In exemplary embodiments, the cap body 105 includes two locking pins 210, e.g., oriented at 180 degrees apart within the cap body 105, as well as two locking slots 215 on the threaded component 115. Of course, other numbers of these components may also be employed with a single use cap according to the disclosed principles.

Other features included in the interior of the cap body 105 are an interior cam 220 and an exterior cam 225. The interior cam 220, which is offset to be positioned further interior than the exterior cam 225 via a projection from the interior wall of the cap body 105, includes a contact surface 220A configured to contact a contact surface of interior cam 125 formed on the threaded component 115. Similarly, the exterior cam 225 includes a contact surface 225A configured to contact a contact surface of the exterior cam 130 of the threaded component 115.

Figure 4A:
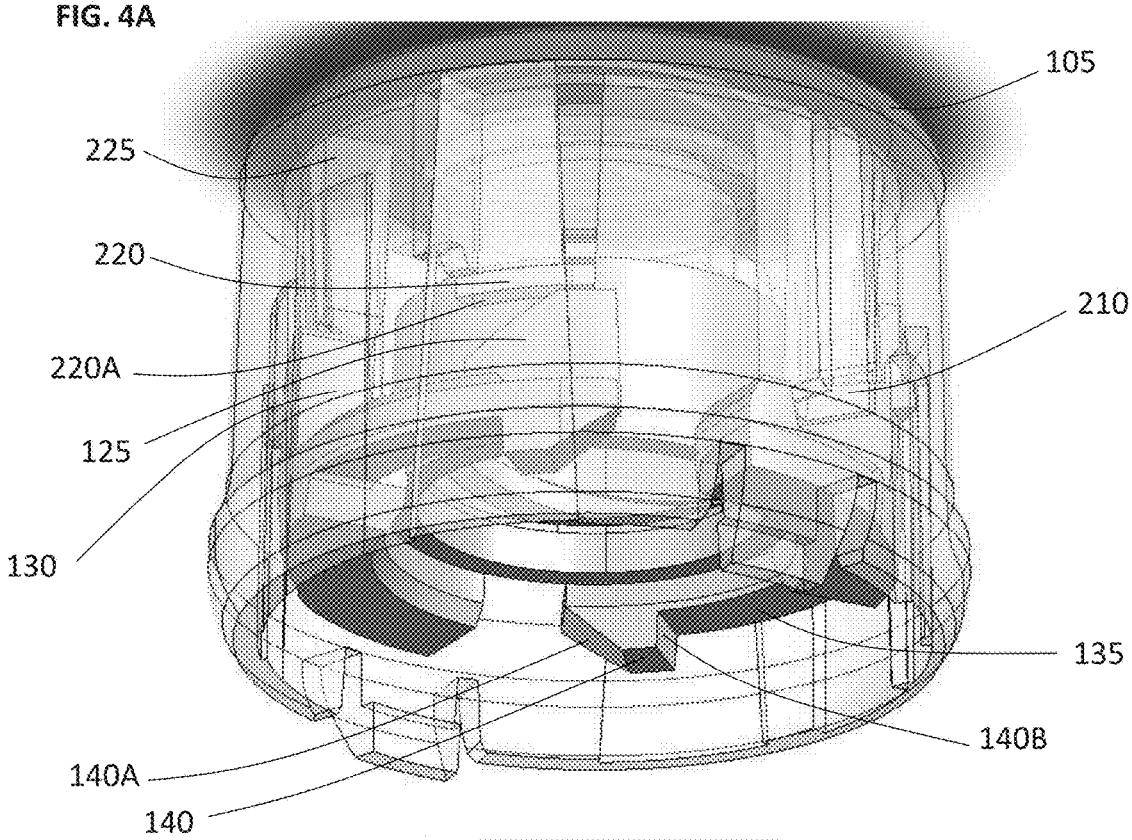
FIG. 4A and FIG. 4B illustrate partially assembled views of the threaded component within the cap body shown in FIGS. 1-3 in the unused state of the cap.
Figure 4B:
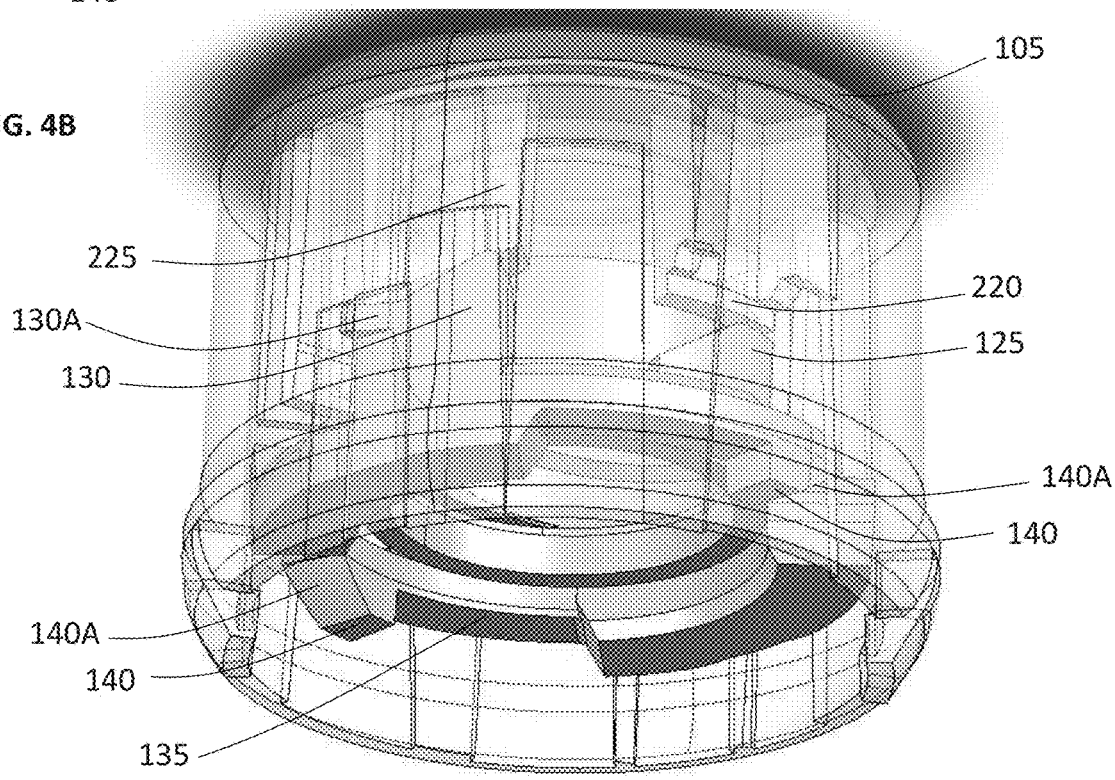

Turning briefly to FIG. 4A and FIG. 4B, illustrated are partially assembled views of the threaded component 115 within the cap body 105 in the unused state of the cap 100. While the positioning of the threaded component 115 within the cap body 105 is the same in both figures, the view is rotated about 30 degrees between FIGS. 4A and 4B, and the cap body 105 is illustrated partially transparent, in order to better show the cooperation of the various features of the threaded component 115 and the interior of the cap body 105. When the single use cap 100 is in its unused state, the threaded component 115 is located at its bottom-most position and rests on the cap base 145 (see FIG. 5). In this position, the topmost portions of the interior cam 125 and exterior cam 130 of the threaded component 115 contact the contact surfaces 220A, 225A, respectively, of the interior cam 220 and exterior cam 225 of the cap body 105. Then, as the cap 100 is tightened onto a receptacle, the position of the threaded component 115 changes with respect to the cap body 105, as described in greater detail below, where the sloped surfaces of the interior cam 125 and exterior cam 130 of the threaded component 115 slide against the corresponding contact surfaces 220A, 225A, respectively, of the interior cam 220 and exterior cam 225 of the cap body 105. As such, the threaded component 115 moves upwards in the interior of the cap body 105 until it reaches its uppermost position and the locking pin(s) 210 are received into the locking slot(s) 215 on the threaded component 115.

Additionally, a plurality of recesses or pockets (collectively, 230) are also formed in the interior of the cap body 105, which are positioned and sized to receive various protruding features of the threaded component 115 as it rotates and moves upwards into the cap body 105. Such recesses 230 may be included on multiple sides of the interior of the cap body 105, as needed and depending on the specific application for which the single use cap 100 has been designed and constructed. Additionally, a secondary locking feature 130A may be included with each exterior cam 130. As the threaded component 115 rotates within and up into the interior of the cap body 105, the secondary locking feature 130A ensures the threaded component 115 can rotate only in a counter-clockwise direction (in this illustrated embodiment) by "falling" within the cavities formed by the ridges separating the walls of recesses 230. Furthermore, a central pocket 240 may be provided in the upper central portion of the interior of the cap body 105. This pocket 240 may be used to secure a sponge or plug (not illustrated) therein, which presses against, or within, the opening 175 of the receptacle 170 on which the single use cap 100 is placed. Alternatively, the pocket 240 may itself be sized to be a plug that is inserted into the opening 175 when the cap 100 is placed on the receptacle 170.

Figure 5:
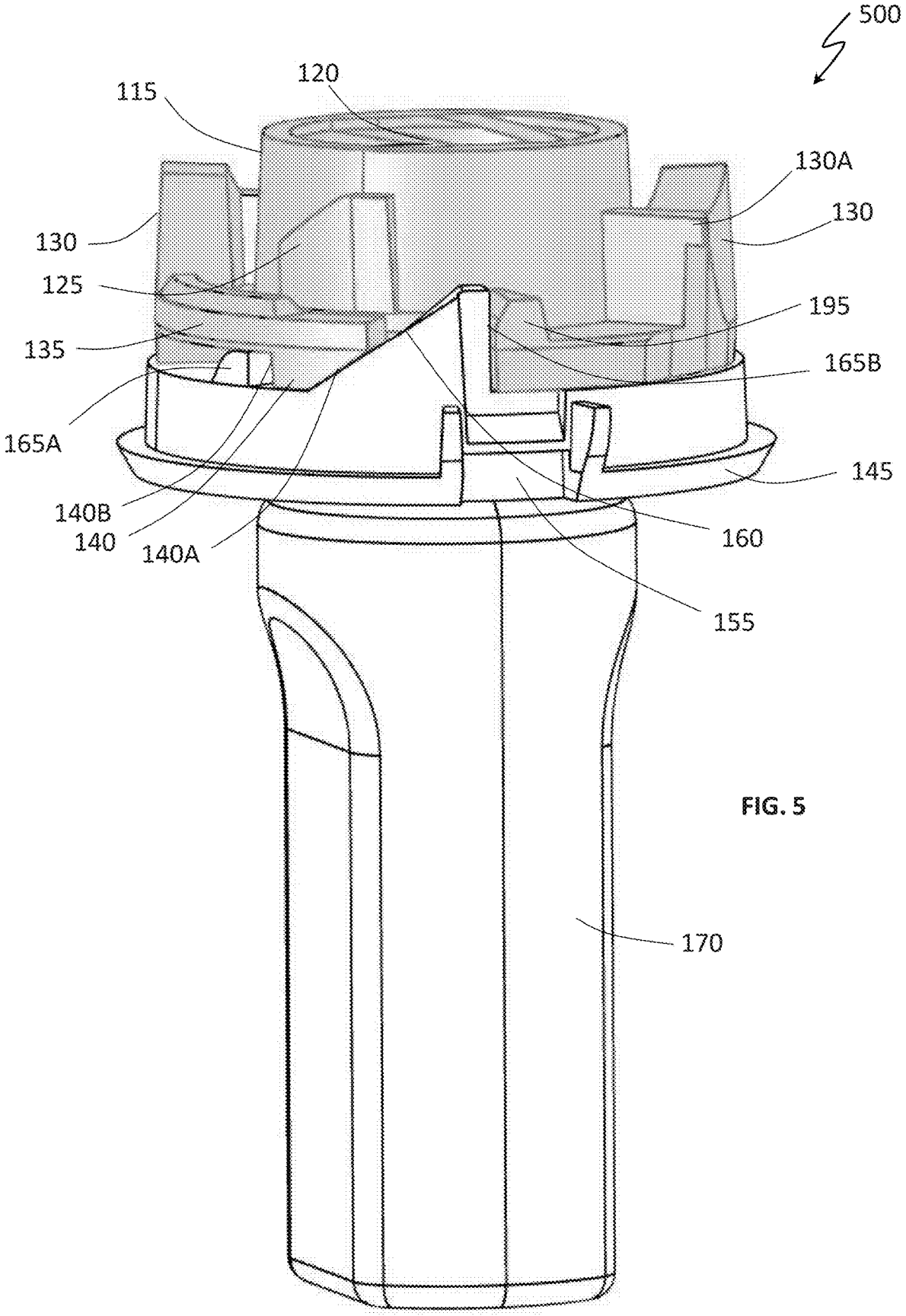
FIG. 5 illustrates a partial assembly of the threaded component and the cap base illustrated in FIGS. 1-4B in an initial position and orientation before the single use cap is placed onto a receptacle.

Looking now at FIG. 5, illustrated is a partial assembly 500 of the threaded component 115 and the cap base 145 in an initial position and orientation before the single use cap 100 is placed onto a receptacle 170. While in this initial position, the clipping element 140 of one of the arms 135 of the threaded component 115 is in contact with the cap base 145. Specifically, the slope of the leading edge 140A of this clipping element 140 rests at the base of the corresponding sloped surface 160 of the cap base 145. In addition, the locking surface 140B of the clipping element 140 is engaged with a corresponding first engaging surface 165A on the cap base 145. Also, an extending portion 195 of the threaded component 115 rests against the second engaging surface 165B so that the threaded component 115 cannot rotate in a clockwise direction with respect to the cap base 145.

Figure 6:
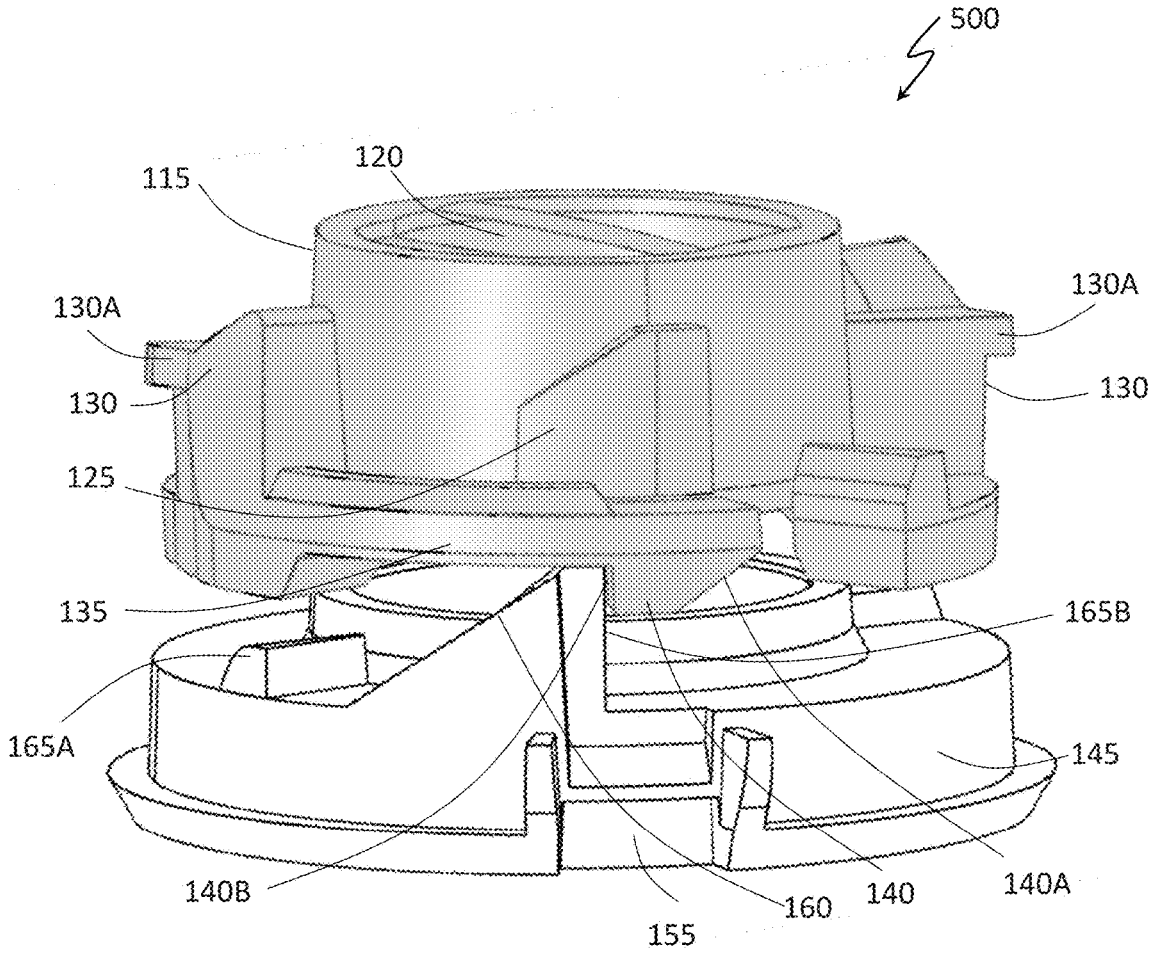
FIG. 6 illustrates the partial assembly of the threaded component and the cap base shown in FIG. 5 in a finished position and orientation after the single use cap is threaded onto a receptacle and the receptacle has been removed.

Turning to FIG. 6, illustrated is the partial assembly 500 of the threaded component 115 and the cap base 145 shown in FIG. 5 in a finished position and orientation after the single use cap 100 is threaded onto a receptacle 170 and removed. More specifically, as assembly 500 (along with the cap body 105 (not illustrated) that is attached to the cap base 145 to form the complete single use cap 100) is placed upon the top of a receptacle and turned (e.g., clockwise), the threads of the receptacle begin to be received by the corresponding threads 120 of the threaded component 115. As the cap body 105, and thus the connected cap base 145, continue to be turned, the threaded component 115 threads down the threaded neck of the receptacle until no further threads exist and the shoulder of a receptacle (e.g., a needleless connector) 170 bottoms out against the shoulder 145A of the cap base 145. Specifically, the shoulder 145A of the cap base 145 is sized such that the threads 185 on the neck 180 of the needless connector 170 or other component pass unobstructed through the shoulder 145A of the cap base 145, but the shoulder 190 does not pass through the shoulder 145A. The threaded component 115 and the cap base 145 are pushed together by the compression force provided by the threads 185 of the receptacle 170 holding the threaded component 115 against the cap base 145 and the shoulder 145A of the cap base 145 pushing against the shoulder 190 or other stop portion of the receptacle 170 that prevents the cap base 145 from moving further downward on the neck 180 of the receptacle 170.

As the rotating force is continued to be applied to the cap base 145 via the grasping of the cap body 105 by the user, the cap base 145 will continue to turn while the threaded component 115 will cease turning. As the cap base 145 continues to be turned, the sloped leading edge 140A of the arm 135 begins to slide up the corresponding sloped surface 160 on the cap base 145. The resiliency of the arm(s) 135 of the threaded component 115 causes the threaded component 115 to be raised within the hollow interior of the cap body 105 via the corresponding sloped surfaces 140A and 160. As discussed above, the sloped surface of the interior cam 125 slides against the corresponding contact surface 220A of the interior cam 220 of the cap body 105, as does the sloped surface of the exterior cam 130 against the corresponding contact surface of the exterior cam 225 in the cap body 105. With continued rotation of the cap base 145 the threaded component 115 continues to move upwards into the cap body 105 until the clipping element 140 of the arms 135 reaches the peak of the sloped surface 160. Once the clipping element 140 passes over the peak of the sloped surface 160, the locking surface 140B of each arm 135 clips down over the peak of the sloped surface 160 and engages the second engaging surface 165B. Additionally, the bottom surface of each arm 135 rests on top of the peaks of the sloped surfaces 160, prohibiting the threaded component 115 from moving back down within the cap body 105.

It should be understood that, while the embodiment of the threaded component 115 illustrated and described herein employs arms 135 and sloped surfaces 160 to move the threaded component 115 from the unused to the used state, the movement of the threaded component 115 can be achieved in many ways. For example, the movement of the threaded component 115 up into the cap body 105 may be by employing features or mechanisms such as one or more springs, foam, rubber, or any expandable/compressible or displaceable material and/or device which would in turn move the threaded component 115 from the unused state to the used state, such as by lifting the threaded component 115 with respect to the cap base 145. Additionally, although the cap base 145 and the threaded component 115 are illustrated and discussed herein as separate, distinctly formed components, in some embodiments the two components may be formed as a single piece. For example, the cap base 145 and the threaded component 115 could be formed as a single piece using injection molding or a similar manufacturing process, wherein the two components are joined with a frangible membrane that, when broken, separates the two components. Moreover, such a frangible membrane may be configured to break when the single use cap 100 is threaded and tightened onto a receptacle in exemplary embodiments.

Figure 7A:
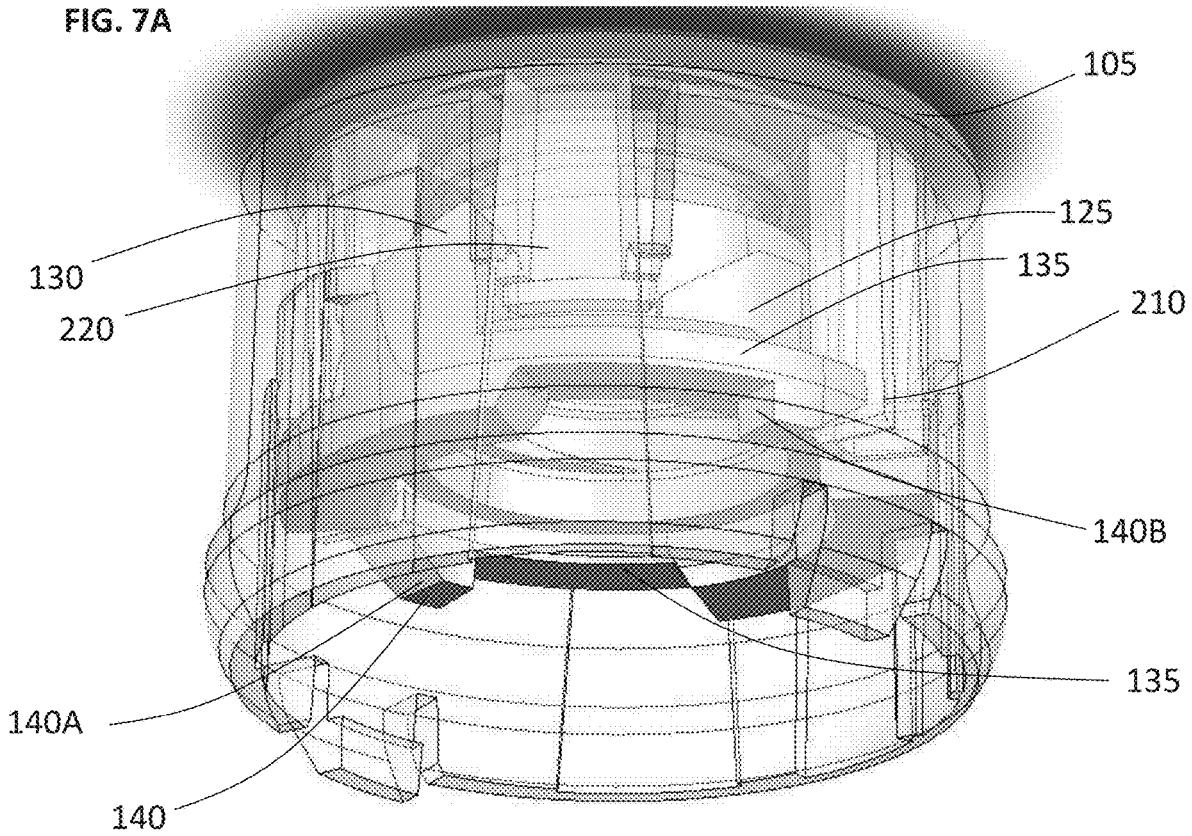
FIG. 7A and FIG. 7B illustrate partially assembled views of the intermediate component within the cap body 105 illustrated in FIGS. 1-6 in the used state of the single use cap.
Figure 7B:
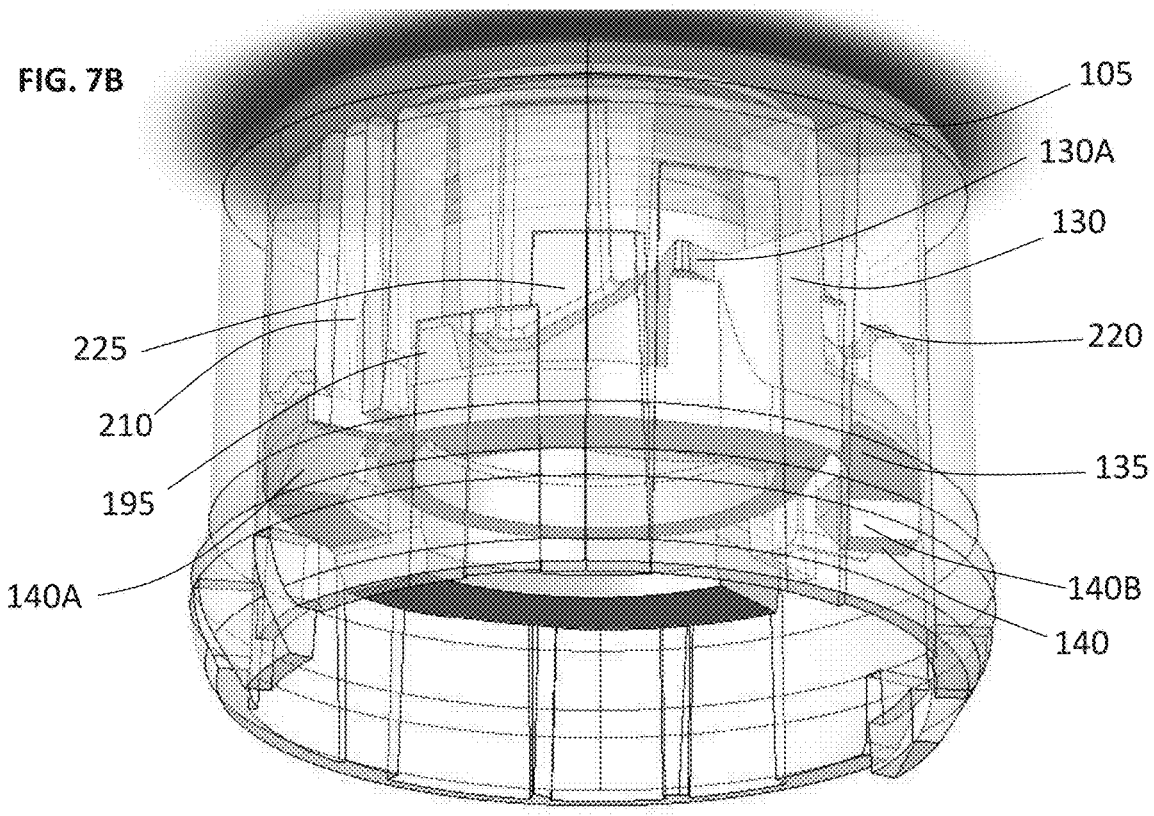

Turning to FIG. 7A and FIG. 7B, illustrated are partially assembled views of the threaded component 115 within the cap body 105 in the used state of the single use cap 100. As before, while the positioning of the threaded component 115 within the cap body 105 is the same in both figures, the view is rotated about 30 degrees between FIGS. 7A and 7B, and the cap body 105 is illustrated partially transparent, in order to better show the cooperation of the various features of the threaded component 115 and the interior of the cap body 105.

When the single use cap 100 is in its used state, the threaded component 115 is located at its uppermost position up inside the interior cavity of cap body 105. The arms 135 of the threaded component 115 continue to contact the cap base 145 by resting on the peaks of the sloped surfaces 160. In the illustrated "used" position, the interior cam 125 and exterior cam 130 of the threaded component 115 have rotated past the contact surfaces 220A, 225A, respectively, of the interior cam 220 and exterior cam 225 of the cap body 105. As a result, the interior cam 220 of the cap body 105 rests close to or on the top surface of the arm 135 between the interior cam 125 and the exterior cam 130. Similarly, exterior cam 225 also rests close to a bottom surface of the threaded component 115 between the exterior cam 130 of the threaded component 115 and the extending portion 195 of the threaded component 115. Also, the locking pins 210 are received within the locking slots 215 of the threaded component 115. Still further, other features formed on the threaded component 115 may be received in the various plurality of recesses or pockets 230 also formed in the hollow interior of the cap body 105. As before, exemplary embodiments of the single use cap 100 include corresponding pairs of the various cams and other features on the threaded component 115 and within the cap body 105, which are offset by 180 degrees.

Once the threaded component 115 is positioned upward in the interior of the cap body 105 at its uppermost position, the threaded component 115 is both prevented from rotating anymore within the cap body 105 and from moving back down towards the cap base 145. Therefore, when the receptacle on which the cap 100 is threaded is unthreaded from the threads 120 of the threaded component 115, the cap 100 unscrews from the receptacle 170 normally. However, once the threads 185 of the receptacle 170 are fully unscrewed from the threaded component 115, the threaded component 115 remains suspended up within the cavity of the cap body 105 by the resting of the arms 135 on the sloped features. Moreover, the clipping element prevents the threaded component 115 from being rotated within the cap body 105 during the unscrewing of the receptacle 170 from the cap 100.

Thus, by being suspended up inside the interior cavity of the cap body 105, the threads of the threaded component 115 are no longer reachable by the threads 185 on the neck 180 of the receptacle 170 if an attempt to reattach the cap 100 to the receptacle 170, or to another receptacle or device. Since the threads 185 of the receptacle 170 can no longer reach the threads 120 of the threaded component 115, the single use cap 100 can no longer be threaded onto the original receptacle 170 or any other receptacle, vessel, needless connector, etc. As a result, any contaminants or substances present within the cap 100 once it is removed from a receptacle cannot be inadvertently transferred to the opening of another receptacle. Accordingly, the cap 100 necessarily becomes a single use cap, in accordance with the disclosed principles.

Figure 8:
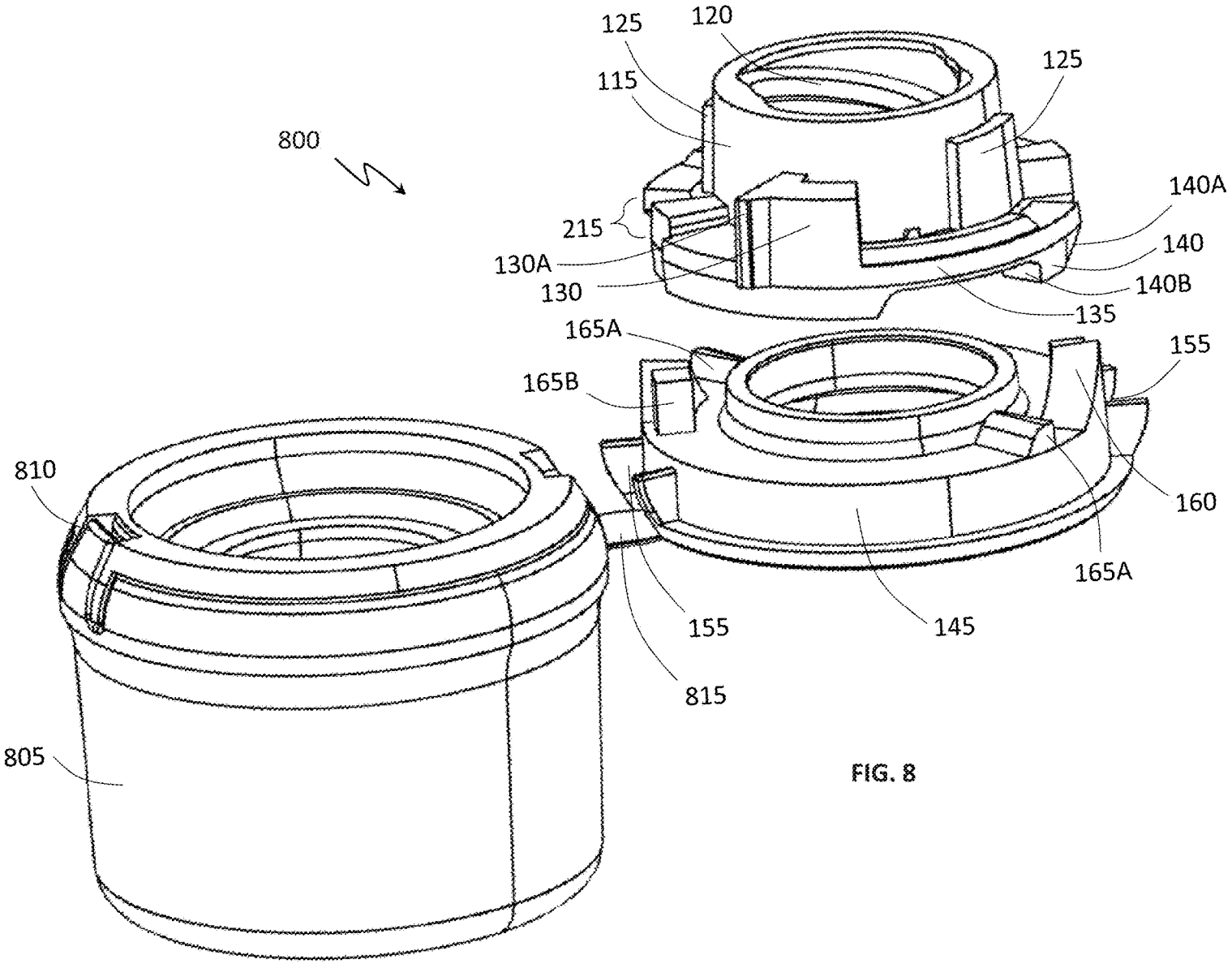
FIG. 8 illustrates an isometric view of another embodiment of a single use cap designed and constructed in accordance with the disclosed principles.

Turning finally to FIG. 8, illustrated is an isometric view of another embodiment of a single use cap 800 designed and constructed in accordance with the disclosed principles. In this embodiment, the single use cap 800 is constructed as a "flip cap" where the cap base 145 is attached to a modified version of the cap base 805. Specifically, the cap base 145 is attached to the cap base 805 using a hinge 815.

In some embodiments, the hinge 815 may be a flexible hinge constructed from plastic or other malleable material. In other embodiments, the hinge 815 may be embodied as two or more components movably affixed together to provide the hinged connection between the cap body 805 and the cap base 145. In exemplary embodiment, the hinge 815 is formed from the same material as the cap body 805, and may be integrally formed with the cap body 805 as a unitary piece. Similarly, in some embodiments, the hinge 815 may be formed from the same material as the cap base 145, and may be integrally formed with the cap base 145 as a unitary piece. In still other embodiments, the hinge 815, cap body 805, and cap base 145 are all formed of the same material, such as plastic, and are all integrally formed as a unitary piece. Of course, any materials and any formation process, such as injection molding, may be used to form any of these components as well as any of the components discussed herein.

To assemble the single use cap 800 of FIG. 8 before use, whether at the time of manufacture or immediate before use, the threaded component 115 is positioned onto the cap base 145 in the proper orientation. Specifically, as discussed in more detail above, the opening in the threaded component 115 is aligned concentrically with the opening the cap base 145. Additionally, the lifting element 140 (which in this embodiment is again a clipping element 140) of the arm 135 of the threaded component 115 is placed between the positioning features 160 (which in this embodiment is again a sloped surface 160) and the first engaging surface 165A such that the leading edge 140A and the locking surface 140B of the clipping element 140 are adjacent the bottom of the sloped surface 160 and the first engaging surface 165A, respectively. In exemplary embodiments there are two arms and two sets of sloped surfaces 160 and first engaging surfaces 165A, and thus both clipping elements 140 of the arms 135 are correspondingly oriented with the components on the cap base 145.

Once the components of the threaded component 115 and those of the cap base 145 are properly aligned, and the threaded component 115 is positioned on the cap base 145, the two components may be inserted into the cap body 805. Specifically, the two joined components are "flipped" over-using the hinge 815 such that both components are inserted into the cap body 805, being careful that the alignment of the components of the threaded component 115 and cap base 145 remains intact. Once both components are inserted into the cap body 805, the fasteners 110 on the cap body 805 are again used to grasp the cap base 145 at the corresponding fastener receivers 155. However, also as before, a single use cap as disclosed herein may not include such fasteners and corresponding receivers, and instead the cap body 105 and the cap base 145 may be joined together in any of a number of various other ways.

Functionally, however, the embodiment of the single use cap 800 illustrated in FIG. 8 operates in the same manner as the embodiments discussed above with reference to FIGS. 1-7B. Specifically, once the complete single use cap 800 is assembled, the cap 800 is placed upon the top of a receptacle (not illustrated) and turned (e.g., clockwise). The threads on the neck of the receptacle begin to be received by the corresponding threads 120 of the threaded component 115. As the cap body 805, and thus the connected cap base 145, continue to be turned, the threaded component 115 threads down the threaded neck of the receptacle until it reaches the end of the threads or until the cap base 145 contacts a stop or other portion of the neck of the receptacle. As the rotating force is continued to be applied to the cap base 145 via the grasping of the cap body 105 by the user of the cap 800, the cap base 145 will continue to turn while the threaded component 115 will cease turning. Moreover, the threaded component 115 and the cap base 145 are pushed together by the compression force provides by the threads holding the threaded component 115 against the cap base 145 and the cap base 145 pushing against the stop or other portion of the receptacle that prevents the cap base 145 from moving further downward on the receptacle.

As the cap base 145 continues to be turned, the sloped leading edge 140A of the arm 135 begins to slide up the corresponding sloped surface 160 on the cap base 145. The resiliency of the arm(s) 135 of the threaded component 115 causes the threaded component 115 to be raised within the hollow interior of the cap body 105 via the corresponding sloped surfaces 140A and 160. As discussed above, the sloped surface of the interior cam 125 slides against the corresponding surface 220A of the interior cam 220 of the cap body 105, as does the sloped surface of the exterior cam 130 against the corresponding surface of the exterior cam 225 in the cap body 105. With continued rotation of the cap base 145 the threaded component 115 continues to move upwards into the cap body 105 until the clipping element 140 of the arms 135 reaches the peak of the sloped surface 160. Once the clipping element 140 passes over the peak of the sloped surface 160, the locking surface 140B of each arm 135 clips down over the peak of the sloped surface 160 and engages the second engaging surface 165B. Additionally, the bottom surface of each arm 135 rests on top of the peaks of the sloped surfaces 160, prohibiting the threaded component 115 from moving back down within the cap body 105.

When the receptacle on which the cap 800 is threaded is unthreaded from the threads 120 of the threaded component 115, the threaded component 115 remains suspended up within the cavity of the cap body 805 by the resting of the arms 135 on the sloped features 160. Moreover, the clipping element 140 prevents the threaded component 115 from being rotated within the cap body 105 during the unscrewing of the receptacle from the cap 100. Once the threaded component 115 is held in its upward position within the interior of the cap body 805, the threaded component 115 is both prevented from rotating anymore within the cap body 805 and prevented from moving back down towards the cap base 145. This is because, as described above, the threads of the threaded component 115 are no longer reachable by the threads on the neck of the receptacle being capped. Since the threads of the receptacle can no longer reach the threads 120 of the threaded component 115, the single use cap 800 can no longer be threaded onto any receptacle. As a result, the cap 800 becomes a single use cap, in accordance with the principles disclosed herein.

Figure 9:
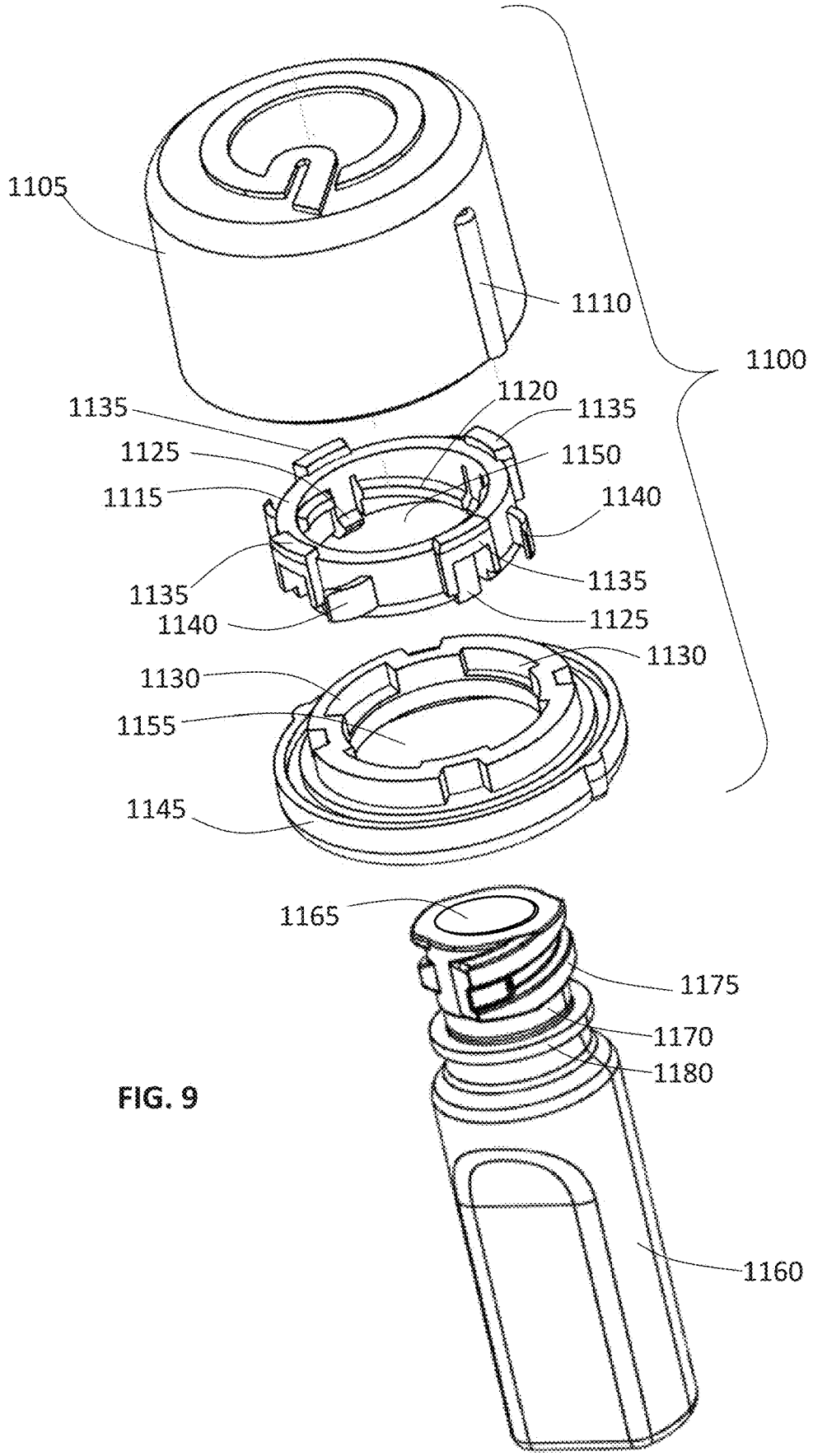
FIG. 9 illustrates an exploded view of another embodiment of a single use cap designed and constructed in accordance with the disclosed principles.

Looking next at FIG. 9, illustrated is an exploded view of another embodiment of a single use cap 1100 designed and constructed in accordance with the disclosed principles. This embodiment of the single use cap 1100 comprises three components, a cap body 1105, an intermediate threaded component 1115, and a cap base 1145. However, in other embodiments two or more components may be combined into a single unitary component or the addition of a separate (e.g., expandable) member that would translate the threaded component from an unused to a used state. Additionally, one or more of the cap body 1105, cap base 1145, and threaded component 1115 may be constructed from a plastic material, and formed, for example, using an injection molding or other plastic formation technique. Alternatively, one or more of the cap body 1105, cap base 1145, and threaded component 1115 may be constructed from a non-plastic material, such as a metal. Of course, any advantageous material may be employed to form any of the cap body 1105, cap base 1145, and threaded component 1115.

The cap body 1105 defines a hollow interior (see FIG. 10) designed and configured to receive the threaded component 1115 therein, and the cap base 1145 at a bottom edge of the cap body 1105. The cap body 1105 also includes one or more ribs 1110 formed on corresponding exterior sides of the cap body 1105 to assist with gripping the cap body 1105 while turning it. This embodiment of the cap body 1105 includes two ribs 1110 oriented at 1180 degrees apart, and includes a small portion of each rib formed on the cap base 1145. When attached, the cap body 1105 and cap base 1145 function as a single piece, wherein the threaded component 1115 is movable within the hollow interior of the cap body 1105 in the manner described in detail below. In alternative embodiments, a single use cap as disclosed herein may not include such ribs 1110, and the cap body 1105 and the cap base 1145 may be joined together in any of a number of various ways, including adhering, welding, or otherwise bonding the two components.

Also illustrated in FIG. 9 is a receptacle or vessel 1160 onto which the single use cap 1100 may be affixed. In this illustrated embodiment, the receptacle 1160 is embodied as a needless connector 1160, which may be used for any of a number of medical procedures, such as IV solutions, catheters, and similar applications. In other embodiments, the receptacle 1160 may also be any type of container, depending on the application. The illustrated receptacle 1160 includes a neck 1170 having an opening 1165, and threads 1175 formed at a distal end of the neck 1170. At a proximal end of the neck is a collar 1180 against which a shoulder of the cap base 1145 rests when the cap 1100 is threaded onto the receptacle 1160.

The threaded component 1115 includes an opening 1150 through its center which features threads 1120 for receiving the threaded end of the receptacle 1160 onto which the single use cap 1100 will be secured. The cap base 1145 also includes a central opening 1155 that is aligned with the opening 1150 in the threaded component 1115; however, the opening 1155 in the cap base 1145 is sized to be larger than the threads 1120 in the threaded component 1115 so that the threaded end of the receptacle 1160 can pass through the cap base 1145 unobstructed. The openings 1150, 1155 of the threaded component 1115 and the cap base 1145 are concentric, and both components are rotatable about an axis of rotation at the center of their openings 1150, 1155.

The threaded component 1115 comprises a plurality of flexible arms 1125 that correspond to slots 1130 formed on interior of the cap base 1145. These flexible arms 1125 are configured to move from a first position to a second position, which corresponds to an initial, unused position for the cap 1100 and a final, used position for the cap 1100, respectively. The functionality of these flexible arms will be discussed in greater detail below.

The cap body 1105 contains features (see FIG. 10) formed in its hollow interior that correspond to and receive therein external alignment features 1135 formed on the exterior of the threaded component 1115. These external alignment features on the threaded component 1115 are comprised, in this illustrated embodiment, as four external cams 1135 located around an outer perimeter of the threaded component 1115, and separated at 90 degree increments around the threaded component 1115. These exterior cams 1135 cooperate with respective features formed in the hollow interior of the cap body 1105 to align and orient the threaded component 1115, as described in further detail with reference to FIG. 10.

The threaded component 1115 also includes at least one external locking feature 1140 formed extending laterally outwardly from the body of the threaded component 1115. In this embodiment, four such locking features 1140 are included and extend from the exterior of the body of the threaded component 1115, and are similarly spaced at 90 degree increments. Of course, other distributions and numbers of locking features 1140 may also be provided with a single use cap as disclosed herein. In this embodiment, each locking feature 1140 is illustrated as a fin 1140 that is tapered as it extends from the threaded component 1115, and the distal end of each fin 1140 is configured to engage corresponding locking features (not shown) on the interior of the cap body 1105, which are discussed in further detail with reference to FIG. 10. Of course, other shapes for the locking features 1140 may also be employed.

Additionally, although the cap base 1145 and the threaded component 1115 are illustrated and discussed herein as separate, distinctly formed components, in some embodiments the two components may be formed as a single piece. For example, the cap base 1145 and the threaded component 1115 could be formed as a single piece using injection molding or a similar manufacturing process, wherein the two components are joined with a frangible membrane that, when broken, separates the two components. Moreover, such a frangible membrane may be configured to break when the single use cap 1100 is threaded and tightened onto a receptacle in exemplary embodiments.

Looking now at FIG. 10, illustrated is a partial exploded view of just the cap body 1105 and the threaded component 1115 illustrated in FIG. 9. The various features formed on the interior of the hollow interior of the cap body 1105 can be seen from this perspective, and these features cooperate with the threaded component 1115 to provide the unique functionality of the disclosed principles. The threaded component 1115 is received within the interior of the cap body 1105 in both initial (unused) and final (used) positions, where certain features within the cap body 1105 are employed depending on which position the threaded component 1115 is in.

The interior of the cap body 1105 includes one or more locking grooves 1205 corresponding to the one or more locking features 1140 formed on the threaded component 1115. Specifically, the tips of the locking features 1140 are configured to engage the corresponding locking grooves 1205 when the threaded component 1115 is in the unused position. While in this unused position, the tops of the external cams 1135 on the threaded component 1115 are in contact with interior cam stops 1210 to prevent the threaded component 1115 from moving upward within the cap body 1105. Also formed in the hollow interior of the cap body 1105 are locking stops 1215 also corresponding to the one or more locking features 1140 on the threaded component 1115. The tips of the locking features 1140 are configured to engage the corresponding locking stops 1215 when the threaded component 1115 is in the used position. While in this used position, the external cams 1135 on the threaded component 1115 have moved past the interior cam stops 1210 and are then pressed against backstops 1225. From this used position, the exterior cams 1135 may then be received into cavities 1220 formed in the cap body 1105. Specifically, in the used position, the threaded component 1115 can now move upward within the cap body 1105 as the tips of the locking features 1140 slide vertically along the corresponding locking stops 1215 and the exterior cams 1135 slide against the backstops 1225 as they are received into the cavities 1220. The movement of the threaded component 1115 from the unused to the used position is discussed in further detail below.

Additionally, a central pocket 1230 may be provided in the upper central portion of the interior of the cap body 1105. This pocket 1230 may be used to secure a sponge or plug (not illustrated) therein, which presses against, or within, the opening 1165 of the receptacle 1160 on which the single use cap 1100 is placed. Alternatively, the pocket 1230 may itself be sized to be a plug that is inserted into the opening 1165 when the cap 1100 is placed on the receptacle 1160. Of course, other plug designs may also be included, or no inclusion of a plug 1230 all, if desired.

Figure 11:
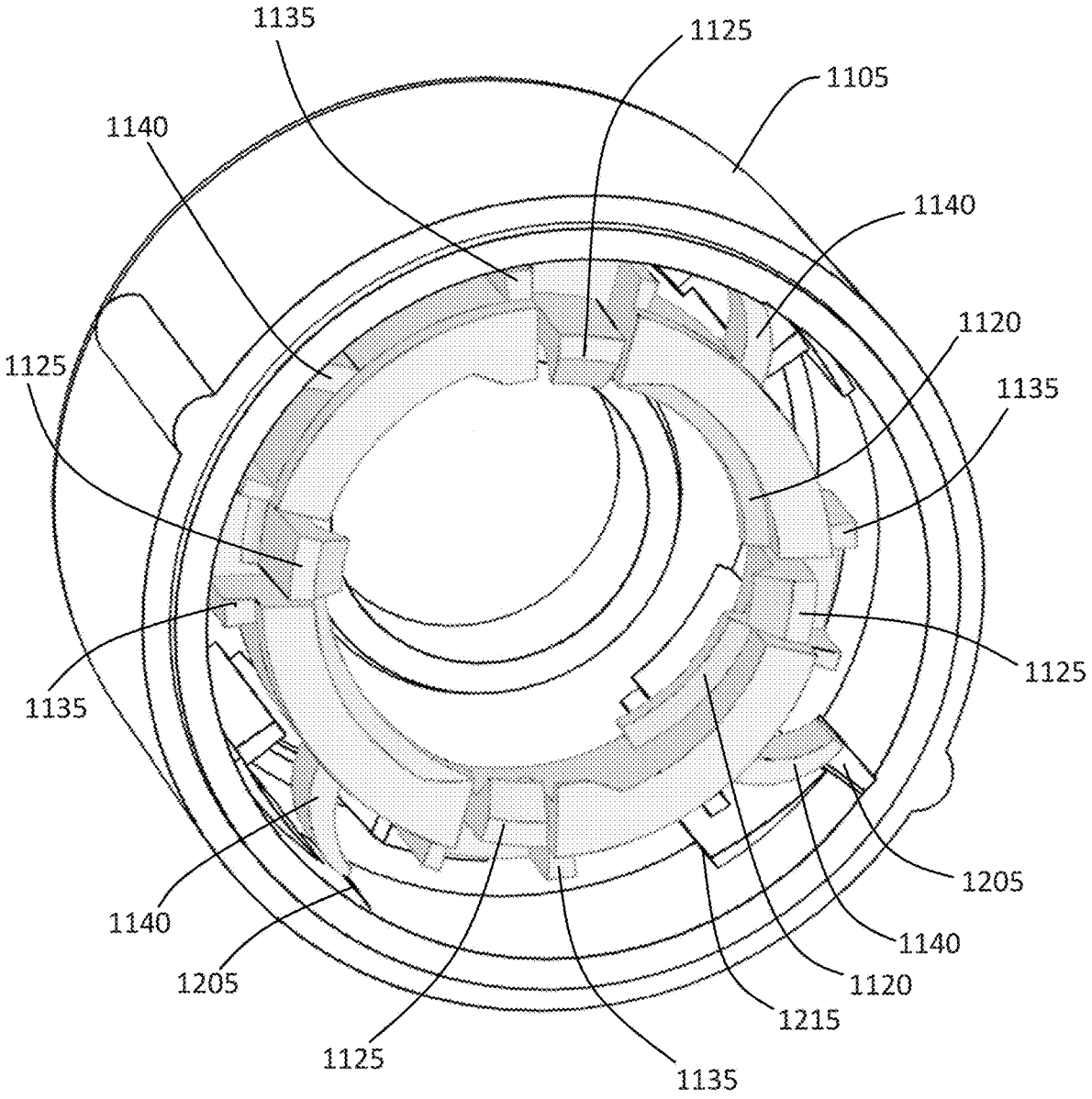
FIG. 11 illustrates a partial assembly of the threaded component within the cap body shown in FIGS. 9-10 in the unused state of the cap.

Turning briefly to FIG. 11, illustrated is a partial assembly of the threaded component 1115 within the cap body 1105 shown in FIGS. 9-10 in the unused state of the single use cap 1100. As shown in this underside view, when the single use cap 1100 is assembled, the threaded component 1115 is positioned within the hollow interior of the cap body 1105 in the unused position. The threaded component 1115 is maintained in a first position prior to the single use cap 1100 being tightened onto a receptacle or vessel, and then maintained in a second position after it has been used on the receptacle. While in this initial position, the tips of the locking features 1140 of the threaded component 1115 are in contact with the locking grooves 1205 in the cap body 1105. In addition, as mentioned above, the tops of the external cams 1135 rest against the interior cams 1210 in the cap body 1105 to prevent the threaded component 1115 from moving upward within the cap body 1105.

Figure 12:
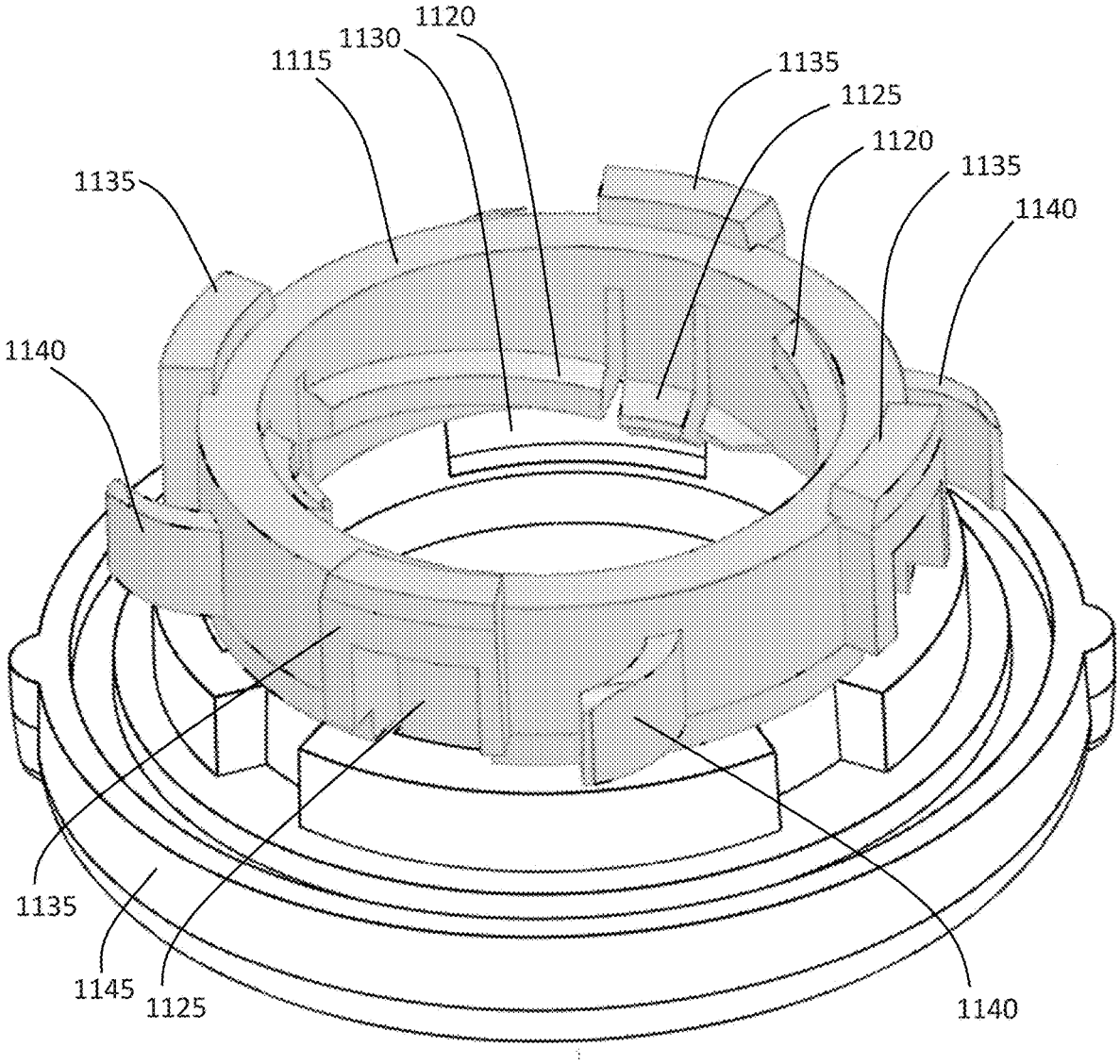
FIG. 12 illustrates a partial assembly of the threaded component and the cap base illustrated in FIGS. 9-10 in an initial, unused position and orientation before the single use cap is placed onto a receptacle.

Looking briefly at FIG. 12, illustrated is a partial assembly of the threaded component 1115 and the cap base 1145 illustrated in FIGS. 9-10 in an initial, unused position and orientation before the single use cap 1100 is placed onto a receptacle. From this view, along with the other various components being illustrated, one of the flexible arms 1125 formed on the threaded component 1115 can be seen extending downwardly into a corresponding slot 1130 formed in the cap base 1145. The positioning of the flexible arm 1125 to right side of the slot 1130 is in the initial, unused position of the threaded portion 1115 with respect to the cap base 1145. As the single use cap 1100 is tightened onto a receptacle 1160, the threaded component 1115 will slide leftward (in this figure) in the slot 1130 until it reaches the finished, used position at the left side of the slot 1130. This movement is described in further detail below with reference to FIG. 13 and FIG. 14.

Figure 13:
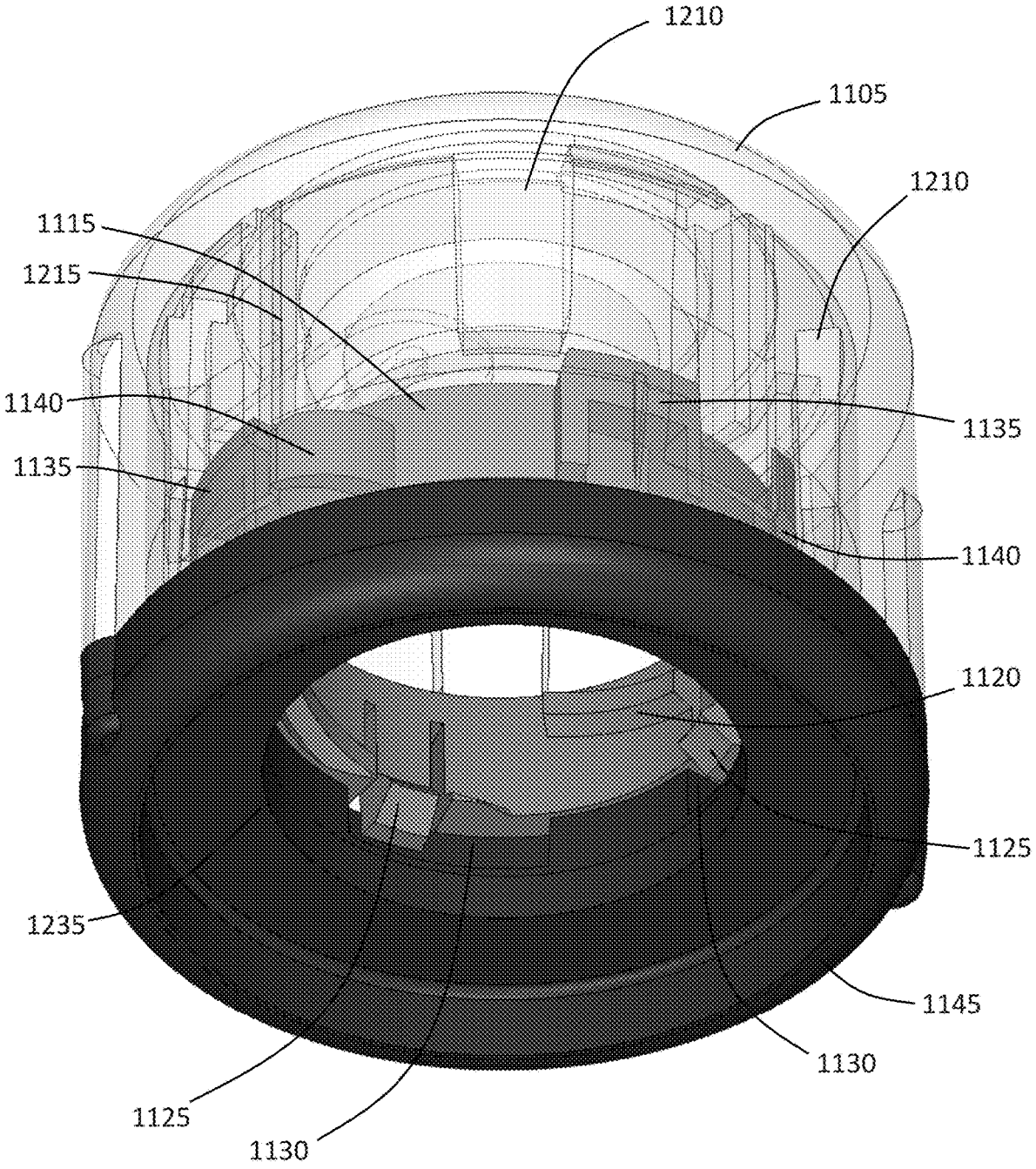
FIG. 13 illustrates a fully assembled, partially transparent view of the single use cap illustrated in FIGS. 9-12 in an initial, unused position and orientation before use on a receptacle.
Figure 14:
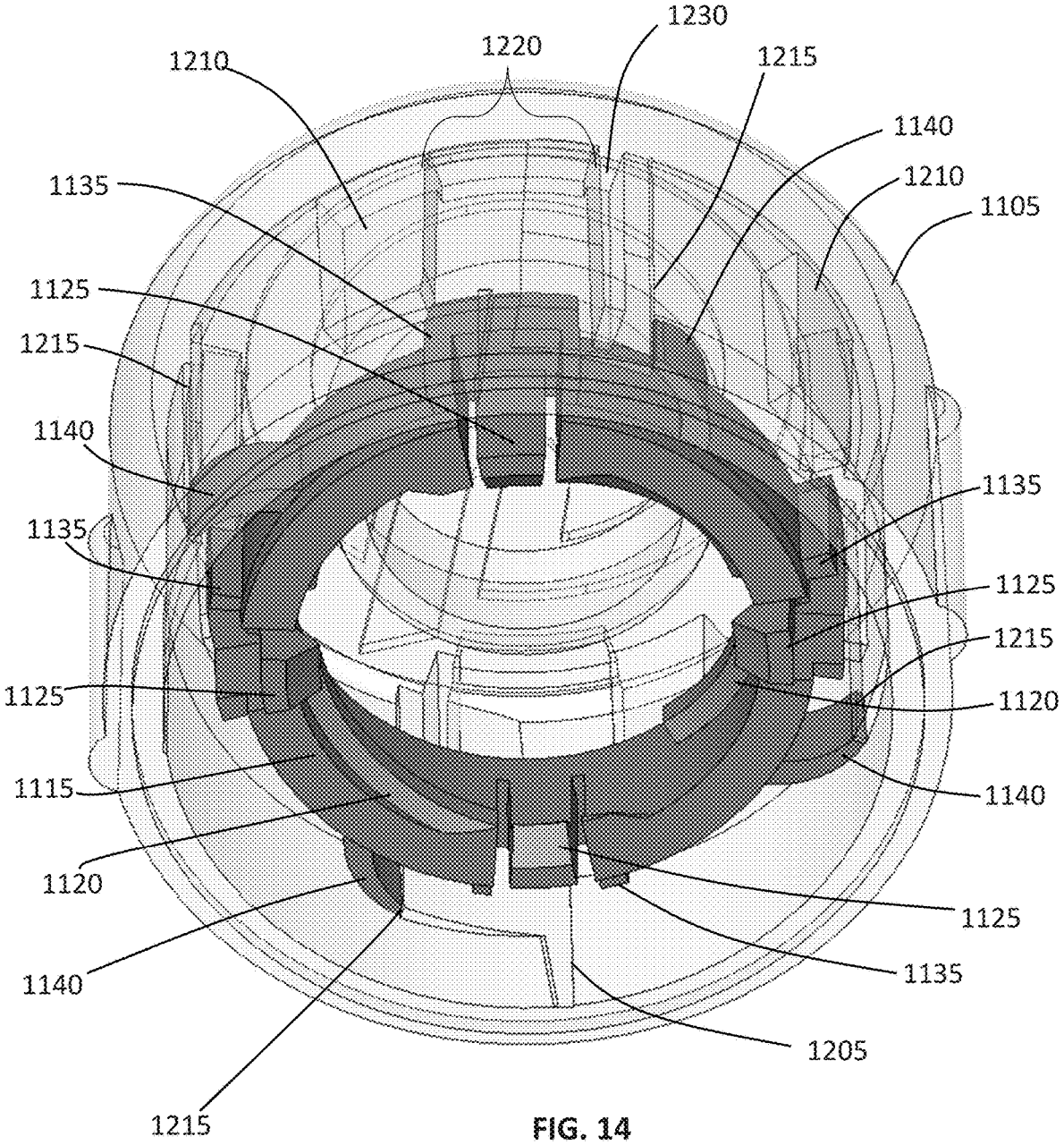
FIG. 14 illustrates a partially transparent view of the threaded component and cap body of the single use cap of FIGS. 9-13 in a finished, used position and orientation after the single use cap is threaded onto a receptacle.

FIG. 13 illustrates a fully assembled, partially transparent view of the single use cap 1100 illustrated in FIGS. 9-12 in final, used position and orientation after use on a receptacle 1160. The cap base 1145 and the threaded component 1115 are illustrated in solid form, while the cap body 1105 is illustrated partially transparent so that the interaction and functionality of the components formed on the threaded component 1115 and the interior of the cap body 1105 can be better seen. FIG. 14 illustrates a partially transparent view of just the threaded component 1115 and cap body 1105 of the single use cap of FIGS. 9-13 in a finished, used position and orientation after the single use cap is threaded onto a receptacle 1160. In this figure, the cap base 1145 is removed to further illustrate the interaction of the components on the threaded component 1115 and the interior of the cap body 1105. FIGS. 13 and 14 are described collectively below.

As the single use cap 1100 is screwed onto the threaded neck 1170 of a receptacle 1160, the threads 1175 of the receptable 1160 are able to reach the threads 1120 formed on the interior of the threaded component 1115. As discussed above, in the unused position, the exterior cams 1135 on the threaded component 1115 are in contact with the bottom ends of the interior cams 1210 in the cap body 1105, which keeps the threaded component 1115 from moving upward into the cap body 1105 as the cap 1100 is placed on a receptacle 1160. Additionally, in the used position, the threaded component 1115 does not yet rotate within the cap body 1105 with respect to the cap base 1145 because the locking features 1140 are engaged with the locking grooves 1205. With the threaded component 1115 held in the initial position, both rotationally and vertically, the flexible arms 1125 on the threaded component 1115 are configured so that they flex outwardly to permit the top edge of the vessel 1160 to move upward and into the center 1150 of the threaded component 1115 in order to engage its threads 1120 as the cap 1100 is pushed onto the receptacle 1160.

As the cap 1100, and thus the threaded component 1115, are threaded onto the neck 1170 of the receptable 1160, the threads 1175 and thus the neck 1170 continue to move upward into the threaded component 1115. As the cap is continued to be turned to affix it to the receptacle 1160, the threaded engagement of the threaded component 1115 and the threads 1175 on the neck 1170 of the receptacle 1160 create a downward force of the threaded component 1115 against the cap base 1145. A shoulder 1235 of the cap base 1145 is thus downwardly pressed onto the collar 1180 of the receptacle 1160. The three components of a cap body 1105, a threaded component 1115, and a cap base 1145 are again shown, as well as a receptacle to which the single use cap 1100 may be attached. Alternate views of the various components of each of these components of the single use cap 1100 are visible in this alternate exploded view. This shoulder 1235 is formed inwardly at the base of the central opening 1155 of the cap base 1145. Specifically, the shoulder 1235 of the cap base 1145 is sized such that the threads 1175 on the neck 1170 of the receptacle 1160, needless connector, or other component pass unobstructed through the shoulder 1235, but the corresponding stop 1180 formed at the base of the neck 1170 does not. Thus, the threaded component 1115 threads down the threads 1165 on the neck 1170 of the receptacle 1160 until no further threads remain and the stop 1180 of the receptacle 1160 bottoms out against the shoulder 1235 of the cap base 1145.

Also, once the cap 1100 is fully threaded onto the receptacle 1160, the opening 1165 of the receptable 1160 contacts the plug 1230 within the cap body 1105 to seal the cap 1100 onto the receptacle 1160. As the cap 1100 continues to be tightened by a user applying the standard twisting motion to the cap 1100, the threaded component 1115 will rotate with respect to the cap base 1145 and cap body 1105 to the finished, used position. As such, the position of the threaded component 1115 changes with respect to the cap body 1105 and cap base 1145. During this change of the position of the threaded component 1115, the flexible arms 1125 slide within the slots 1130 from the right side (as oriented in these figures) to the left side of the slots 1130.

The external cams 1135 similarly slide leftward with respect to the interior cams 1210 in the cap body 1105 until they reach corresponding cavities 1220. Similarly, the tips of the locking features 1140 slide along ramps formed in the cap body 1105 and which terminate in corresponding locking steps 1215. Once reaching the locking steps 1215, the tips of the locking features 1140 are now locked onto the locking steps 1215 as the exterior cams 1135 press laterally against backstops 1225. The combination of the locking features 1140 engaging the locking steps 1215 and the external cams 1135 engaging the backstops 1225 prevents the threaded component 1115 from further rotation in either direction. However, the threaded component 1115 is now permitted to move vertically within the cap body 1105, and this limited movement of the threaded component 1115 represents its final, used position. In this position, the external cams 1135 may move upwardly toward the top of the interior of the cap body 1105 into the cavities 1220 as the threaded component 1115 moves upward (and downward) freely within the cap body 1105. In this illustrated embodiments, the threaded component 1115 includes four external cams 1135 which are received within four corresponding cavities 1220 in the cap body 1105. Of course, other numbers of these components may also be employed with a single use cap according to the disclosed principles.

Figure 15:
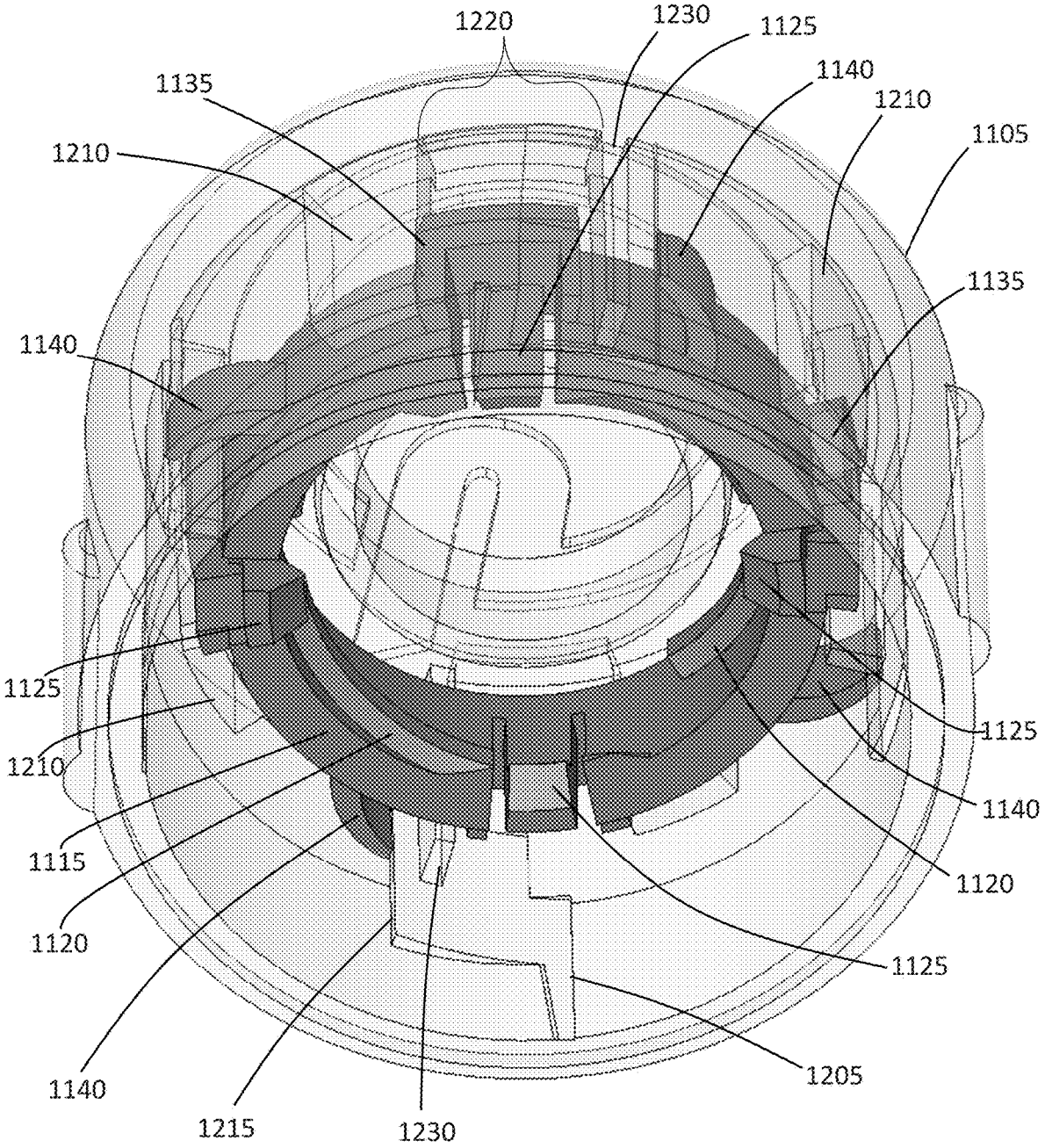
FIG. 15 illustrates a partially transparent view of the threaded component and cap body of the single use cap of FIG. 14 in a finished, used position and orientation, and with the threaded component in a raised position.
Figure 16:
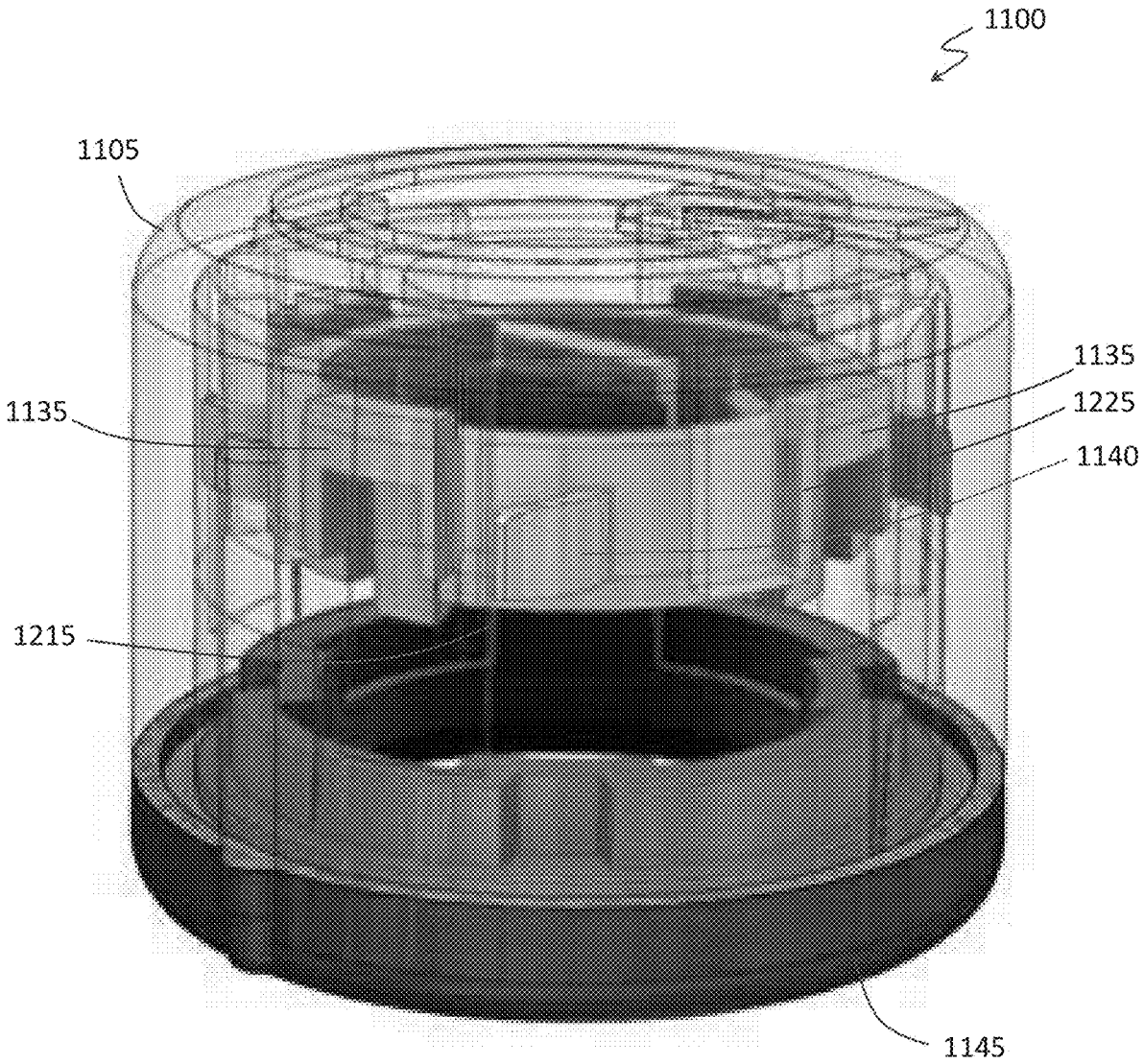
FIG. 16 illustrates a fully assembled, partially transparent view of the single use cap of FIG. 15 a finished, used position and orientation, and with the threaded component in a raised position.

Referring now to FIG. 15, illustrated is a partially transparent view of the threaded component 1115 and cap body 1105 of the single use cap 1100 of FIGS. 13 and 14 in a finished, used position and orientation, and with the threaded component 1115 in a raised position. As discussed in detail above, once the threaded component 1115 is in the finished, used position, the threaded component 1115 is permitted to freely move upward and downward within the hollow cavity of the cap body 1105, while being prevented from rotating in either direction. FIGS. 15 and 16 illustrate the threaded component 1115 in a raised position within the cap body 1105, which occurs when the used single use cap 1100 is attempted to affixed to a receptacle as second time. Specifically, as the used cap 1100 is placed over the neck 1170 of a receptacle 1160, the top edge or lip of the neck 1170 defining the opening 1165 contacts the flexible arms 1125 when the threaded component 1115 has slide (e.g., via gravity) to the lower, used position.

The contact with the flexible arms 1125 assist with moving the threaded component 1115 upwards into the cap body 1105. Specifically, the flexible arms 1125 previously flexed outwardly from the force of pressing an unused cap 1100 onto a receptacle 1160 because the exterior cams 1135 contacting the interior cams 1210 prevented the threaded component 1115 from moving upwards, and thus the neck 1170 and its threads 1175 would push past the flexible arms 1125 so that the threads 1175 could engage the threads 1120 in the threaded component 1115. However, with the threaded component 1115 permitted to move freely vertically within the cap body 1105 when in the used position, the flexible arms 1125 are sufficiently rigid so that contact by the neck 1170 as a used cap 1100 is placed on a receptacle simply pushes the flexible arms 1125, and thus the threaded component 1115, upward into the cap body 1105. Consequently, the threads 1175 of the receptacle 1160 are not permitted to reach the threads 1120 in the threaded component 1115, and thus the used cap 1100 cannot be rethreaded onto the receptacle 1160.

Turning now to Looking briefly at FIG. 16, illustrated is a fully assembled, partially transparent view of the single use cap 1100 in the finished, used position and orientation shown in FIG. 15. In this illustration, the cap base 1145 and the threaded component 1115 are illustrated in solid form, while the cap body 1105 is illustrated partially transparent so that the interaction and functionality of the components formed on the threaded component 1115 and the interior of the cap body 1105 can be better seen when the threaded component 1115 is in its maximum upward used position.

In exemplary embodiments, the length of vertical movement of the threaded component 1115 within the cap body 1105 may be selected such that the flexible arms 1125 are not capable of being forced outwardly again by continued pushing of the used cap 1100 onto the neck 1170 once the threaded component 1115 has reached its maximum vertical movement within the cap body 1105. Instead, the stop 1180 at the base of the neck 1170 of the receptacle 1160 will contact the collar 1235 on the cap base 1145 so that the neck 1170 and its threads 1175 cannot be pushed further upward into the cap body 1105 in order to eventually reach the threads 1120 on the threaded component 1115.

Figure 17A:
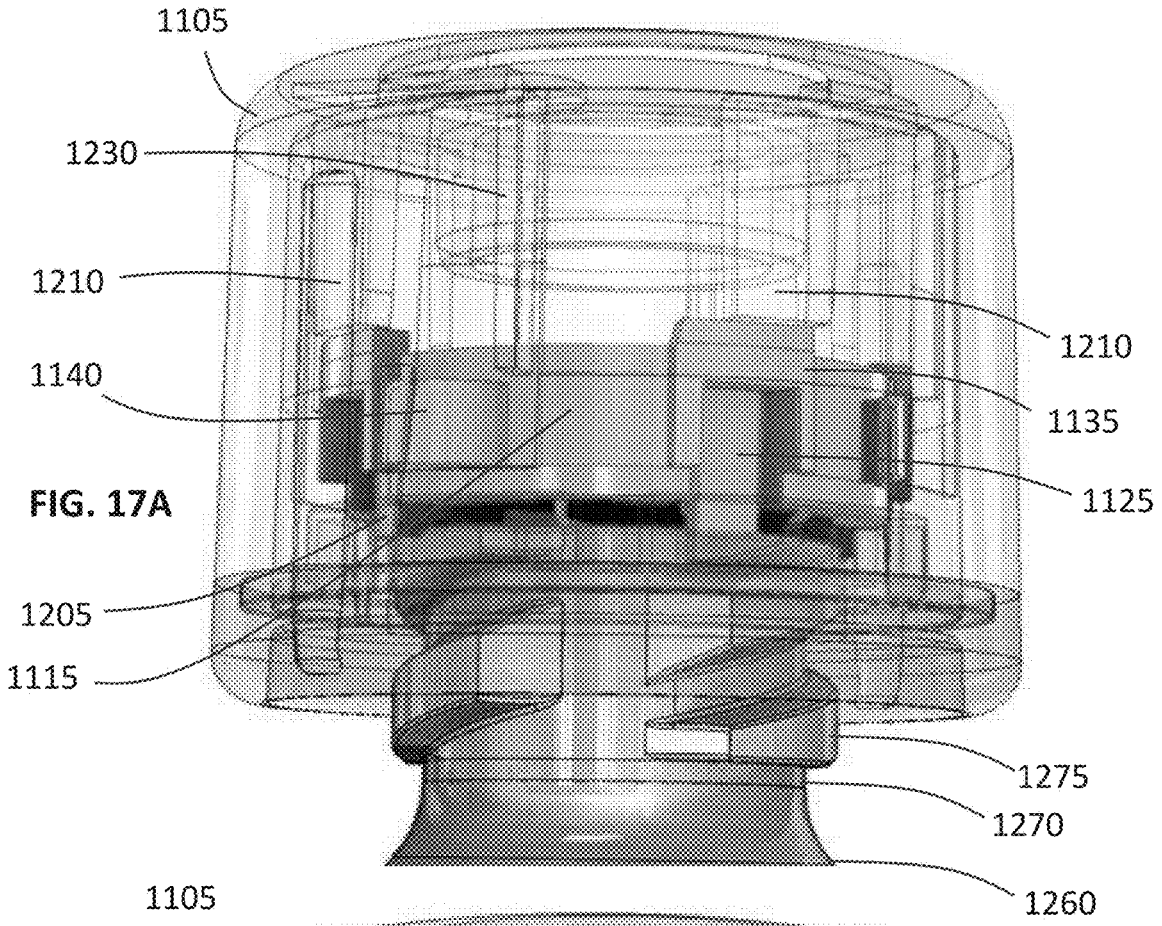
FIG. 17A illustrates a single use cap in accordance with the disclosed principles in an unused position as it is being affixed onto a receptacle.

Turning now to FIG. 17A illustrates a single use cap 1100 in accordance with the disclosed principles in an unused position as it is being affixed onto a receptacle 1260. As shown, the threaded component 1115 is its unused position as the cap 1100 is placed onto the receptacle 1260. In this unused position, the top surfaces of the exterior cams 1135 are contacting the bottom surfaces of the interior cams 1210, which prevents the threaded component 1115 from moving upward into the cap body 1105. Also, the locking features 1140 are engaged within grooves 1205, which prevents the threaded component 1115 from rotating clockwise, but not counter-clockwise.

Ask described in detail above, once the cap 1100 via the threaded component 1115 is screwed onto the threads 1275 on the neck 1270 of the receptacle 1260, the continued twisting of the cap 1100 on the neck 1270 causes the threaded component 1115 to rotate counter-clockwise with respect to the cap body 1105 once the threads 1275 of the receptacle 1260 have bottomed-out on the threaded component 1115. The threaded component 1115 will thus rotate counter-clockwise with respect to the cap body 1105 until the exterior cams 1135 reach the backstops 1230, and the tips of the locking features 1140 lock on the steps 1215. The threaded component 1115 would then be in the used position and would be permitted to freely move up and down within the cap body 1105 in the manner discussed in detail above.

Figure 17B:
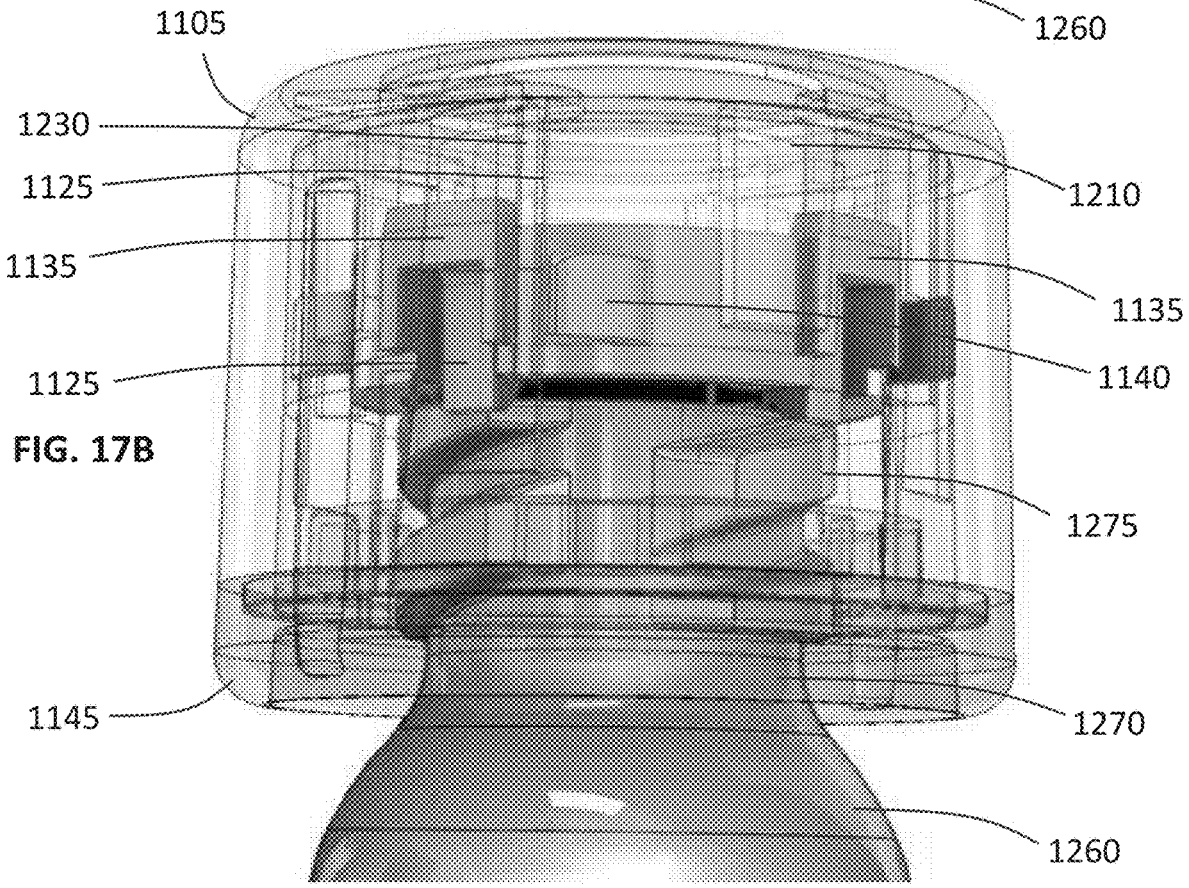
FIG. 17B illustrates a single use cap of FIG. 17A in a used condition as it is attempted to be re-affixed on the receptacle illustrated in FIG. 17A.

Turning finally to FIG. 17B illustrates the single use cap 1100 of FIG. 17A in a used condition as it is attempted to be re-affixed on the receptacle 1260 illustrated in FIG. 17A. As the cap 1100 is replaced on top of the receptacle 1260, the bottom ends of the flexible arms 1125 are contacted by the top of the receptacle 1260. Once contacting the flexible arms 1125, as the cap 1100 is attempted to be rethreaded on the neck 1270 of the receptacle 1260, the free vertical movement of the threaded component 1115 results in it moving upward into the cap body 1105 as shown in FIG. 117B. As the threaded component 1115 moves upward, and thus the flexible arms 1125 are not moved outwardly by the neck 1270 of the receptacle 1260, the threads 1275 of the receptacle 1260 cannot reach the threads 1120 in the threaded component 1115. Consequently, the used cap 1100 cannot be rethreaded onto the receptacle 1260.

Figure 18:
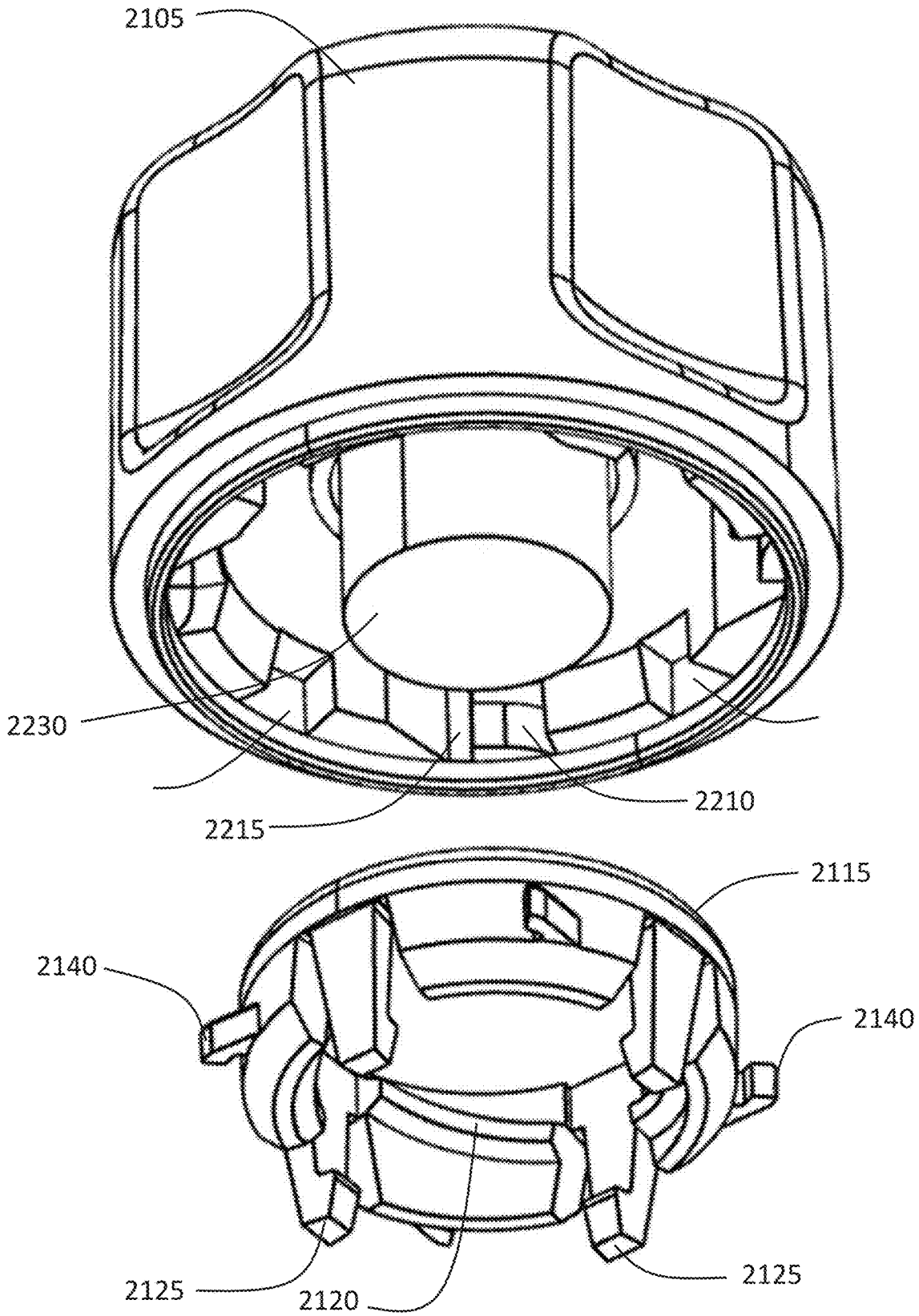
FIG. 18 illustrates a partial exploded view of just the cap body and the intermediate threaded component of a third embodiment of a single use cap in accordance with the disclosed principles.

Turning now to FIG. 18, illustrated is a partial exploded view of just the cap body 2105 and an intermediate threaded component 2115 of a third embodiment of a single use cap designed and constructed in accordance with the disclosed principles. The various features formed on the interior of the hollow interior of the cap body 2105 can be seen from this perspective, and these features cooperate with the threaded component 2115 to provide the unique functionality of the disclosed principles. The threaded component 2115 is received within the interior of the cap body 2105 in both initial (unused) and final (used) positions, where certain features within the cap body 2105 are employed depending on which position the threaded component 2115 is in. The threaded component 2115 is maintained in a first position prior to the single use cap being tightened onto a receptacle or vessel, using threads 2120, and then maintained in a second position after it has been used on the receptacle. The interior of the cap body 2105 includes one or more pockets 2210 corresponding to the one or more locking features or "fins" 2140 outwardly extending from the threaded component 2115. Specifically, the locking features 2140 are configured to engage the corresponding pockets 2215 when the threaded component 2115 is in the unused position.

While in this unused position, the tops of the locking features 2140 on the threaded component 2115 are in contact with top edges of the interior pockets 2215 to prevent the threaded component 2115 from moving upward within the cap body 2105. Also formed in the hollow interior of the cap body 2105 are channels 2215, which correspond to the size and positions of the one or more locking features 2140 on the threaded component 2115. The tips of the locking features 2140 are configured to engage corresponding locking stops 2220 formed along one edge of each channel 2215 when the threaded component 2115 is in the used position. While in this used position, the locking features 2140 are received into the channels 2215, and thus the threaded component 2115 can now move upward within the cap body 2105 as the tips of the locking features 2140 slide vertically along the corresponding locking stops 2220. The movement of the threaded component 2115 from the unused to the used position is discussed in further detail below.

Additionally, a central pocket may be provided in the upper central portion of the interior of the cap body 2105. This pocket may be used to secure a sponge or plug 2230 therein, which presses against, or within, an opening of the receptacle (not illustrated) on which the single use cap 2100 is placed. Of course, other plug designs may also be included, or no inclusion of a plug 2230 all, if desired.

Figure 19A:
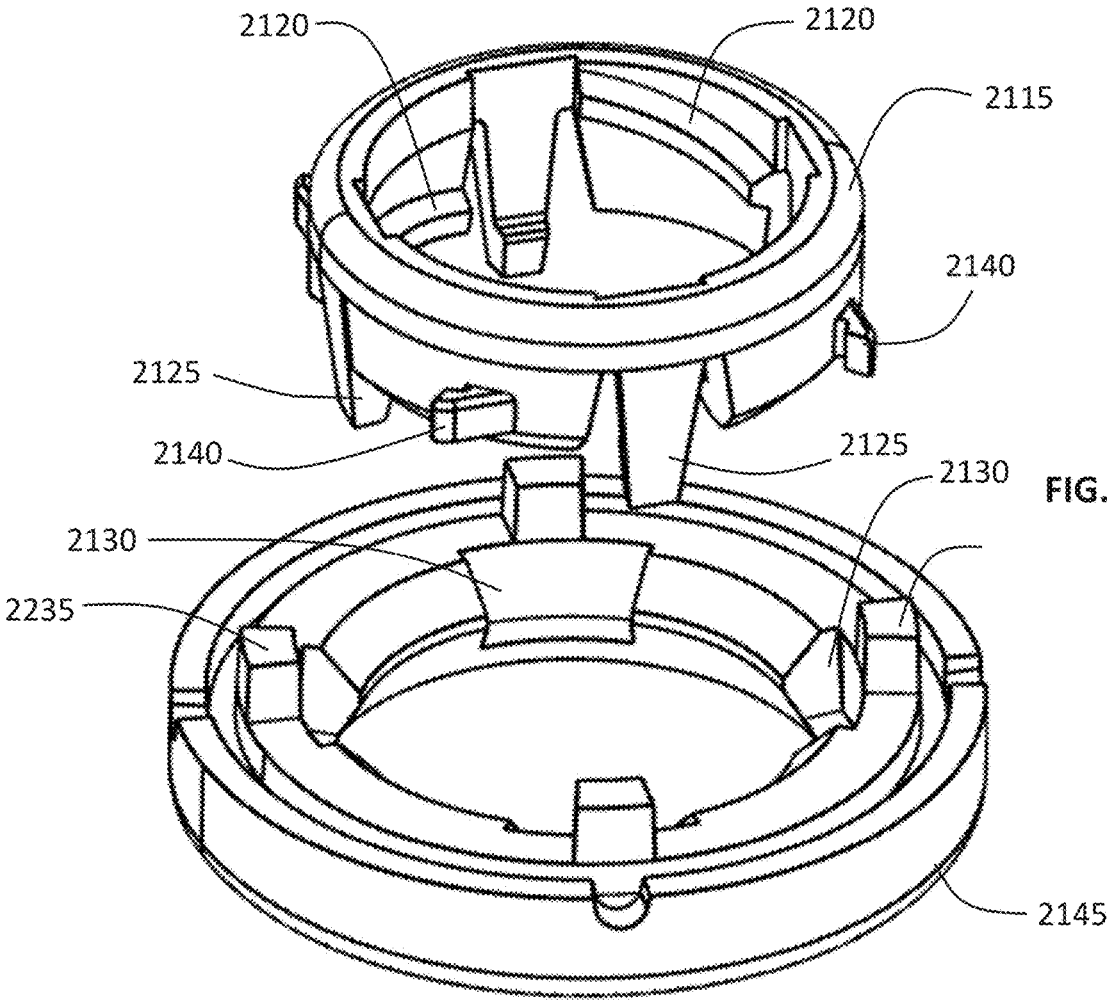
FIG. 19A illustrates an exploded view of a partial assembly of the threaded component and the cap base of the embodiment of the single use cap illustrated in FIG. 18.
Figure 19B:
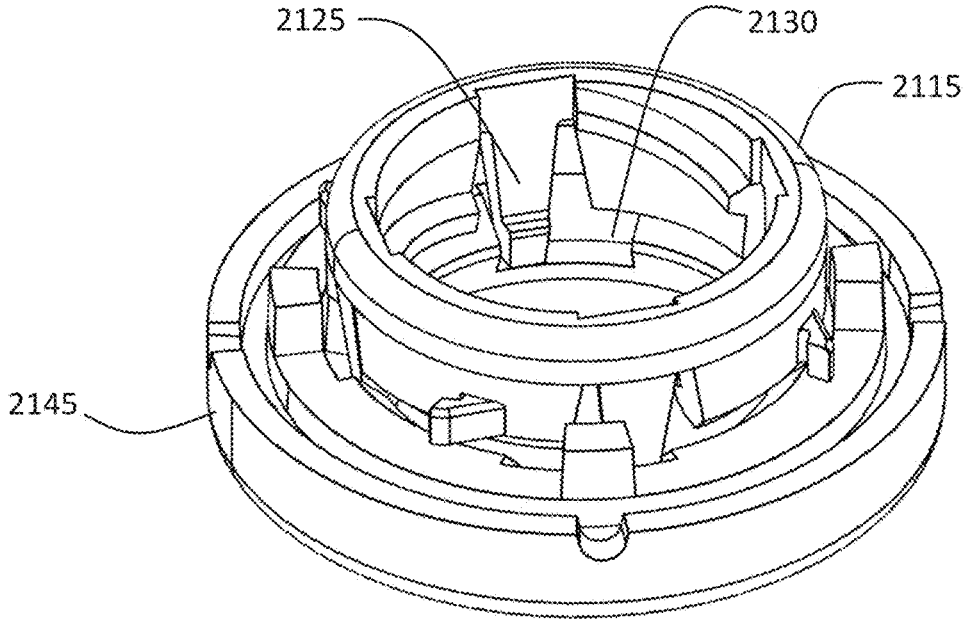
FIG. 19B illustrates an assembled view of the partial assembly of the threaded component and the cap base illustrated in FIG. 19A.

FIG. 19A illustrates an exploded view of a partial assembly of the threaded component 2115 and the cap base 2145 of the embodiment of the single use cap illustrated in FIG. 18. FIG. 19B illustrates an assembled view of the partial assembly of the threaded component 2115 and the cap base 2145 illustrated in FIG. 19A. From these views, along with the other various components being illustrated, one of the flexible arms 2125 formed on the threaded component 2115 can be seen extending downwardly into a corresponding slot 2130 formed in the cap base 2145. The positioning of the flexible arm 2125 to the right side of the slot 2130 shown in FIG. 19A is the initial, unused position of the threaded portion 2115 with respect to the cap base 2145. As the single use cap is tightened onto a receptacle, the threaded component 1115 will slide leftward (in FIG. 19A) in the slot 2130 until it reaches the finished, used position is at the left side of the slot 2130 shown in FIG. 19A. FIG. 19B illustrates the threaded portion 2115 in the used position with respect to the cap base 2145, after the cap has been tightened onto a receptacle and thus rotated into the used state.

Figure 20A:
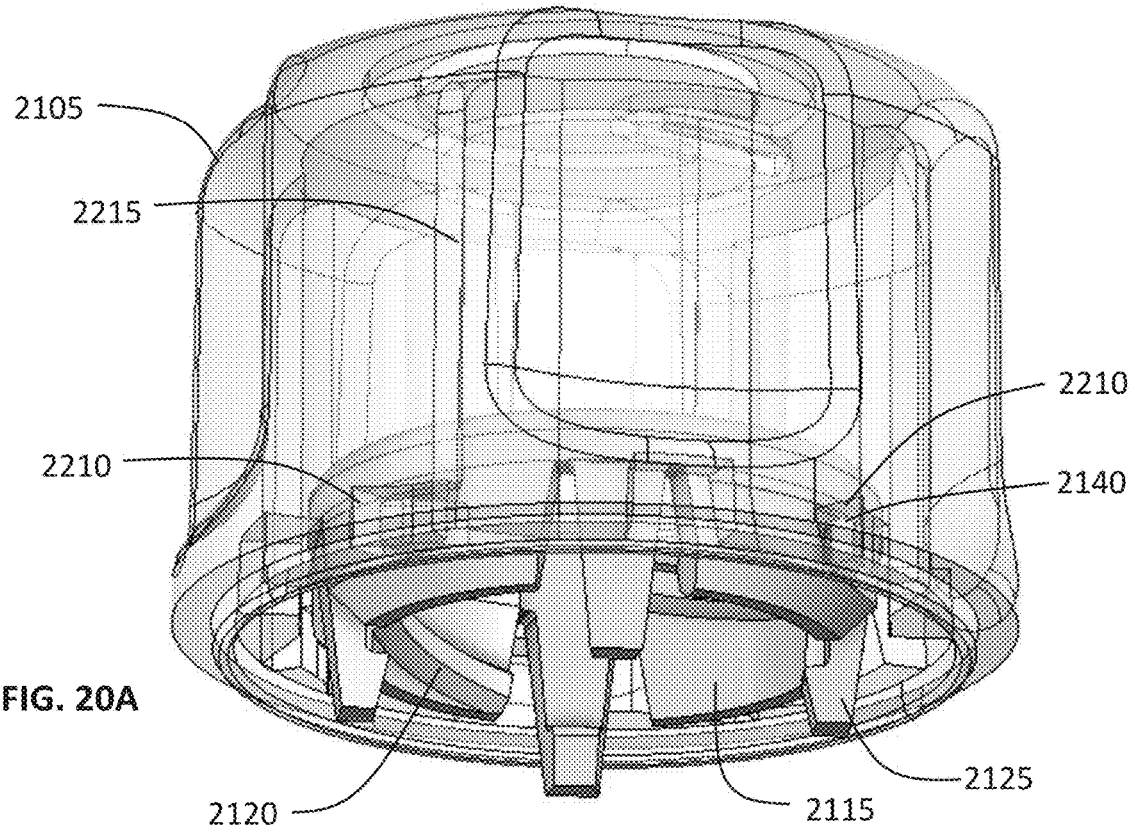
FIG. 20A illustrates a partially assembled view of the threaded component within the cap body shown in FIGS. 18-19 in the unused state of the cap.

Turning now to FIG. 20A, illustrated is a partially assembled view of the threaded component 2115 within the cap body 2105 shown in FIGS. 18-19 in the unused state of the cap. In this unused state, the threaded component 2115 is positioned at its lowest point in the cap body 2105, and each of the locking features 2140 are at rest within corresponding pockets 2210. From this lowest position, the extending arms 2125 are positioned and configured to flex outwardly as the neck of a receptable or other vessel (not illustrated) is received within the threaded component 2115 using the threads 2120 formed therein.

Figure 20B:
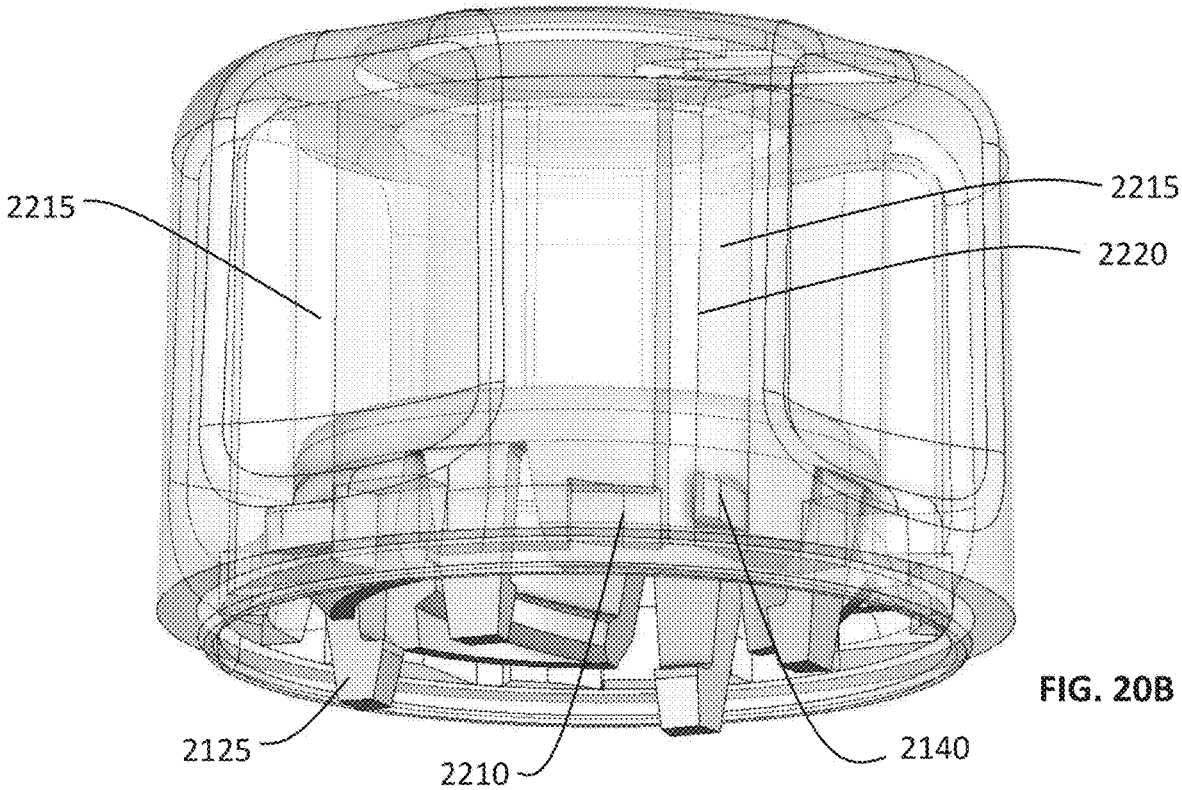
FIG. 20B illustrates a partially assembled view of the threaded component within the cap body shown in FIG. 20A in the first stage of the used state of the cap.

FIG. 20B illustrates a partially assembled view of the threaded component 2115 within the cap body 2105 shown in FIG. 20A in the first stage of the used state of the cap. At this first stage, the threaded component 2115 has been rotated within the cap body 2105 be the tightening of the cap onto a receptacle (not illustrated). Specifically, once the cap has been tightened onto the threaded neck of a receptacle to a predetermined depth, the continued turning of the cap causes the threaded component 2115 to rotate with the cap body 2105, as discussed with respect to the other cap embodiments discussed above. The first stage of the used position is reached when the locking features 2140 have rotated into each's corresponding channel 2215, and the tips of the locking features 2140 have engaged the locking stops 2220 formed along one edge of each channel 2215. This location of the locking features 2140 within the corresponding channels 2215 permits the threaded component 2115 to be movable upward and into the hollow interior of the cap body 2105.

Figure 20C:
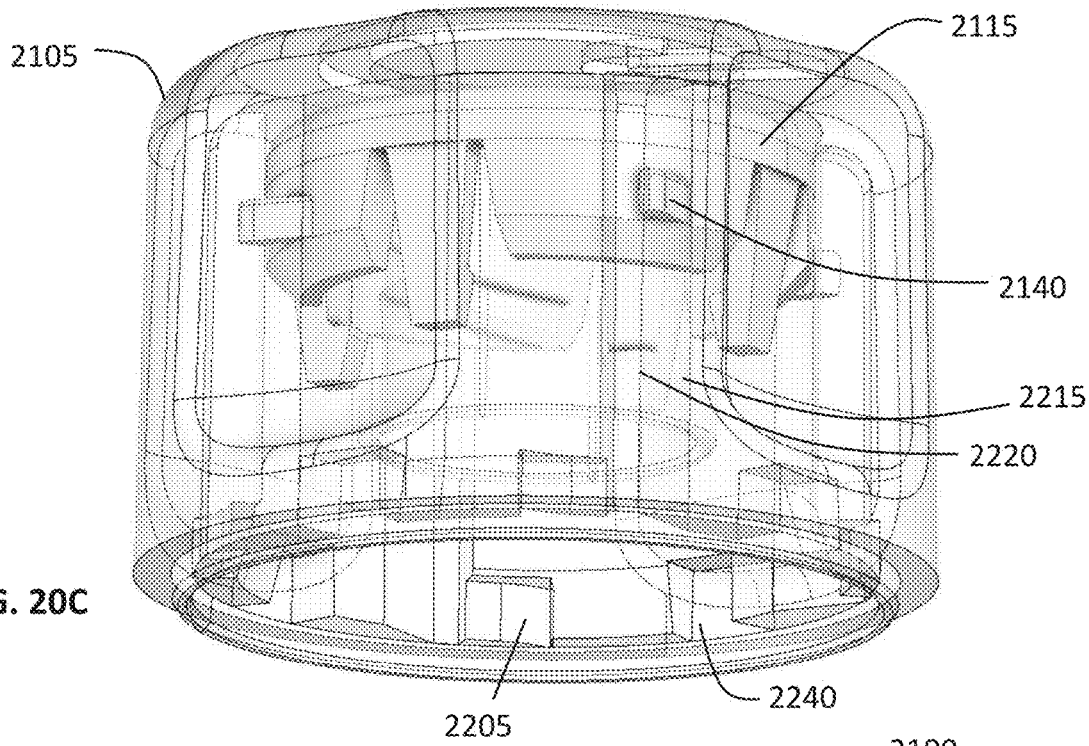
FIG. 20C illustrates a partially assembled view of the threaded component within the cap body shown in FIGS. 20A-20B in the final stage of the used state of the cap.

FIG. 20C illustrates a partially assembled view of the threaded component 2115 within the cap body 2105 shown in FIGS. 20A-20B in the final stage of the used state of the cap. In this final stage of the used state, the threaded component 2115 is slid to the top of the interior of the cap body 2105. Specifically, as described above, once the threaded component 2115 has been rotated by the continued twisting of the cap onto a receptacle, the locking fins 2140 have slid into the channels 2215, with the tips of the locking fins 2140 engaging the locking stops 2220. As the threaded component 2115 slides up into the cap body 2105, for example, when a used cap is attempted to be rethreaded onto a receptacle. In this situation, the lower tips of the extending arms 2125 contact the top edge of a receptacle, and thus are used to push the threaded component 2115 up into the cap body 2105 once it has been used.

Figure 21:
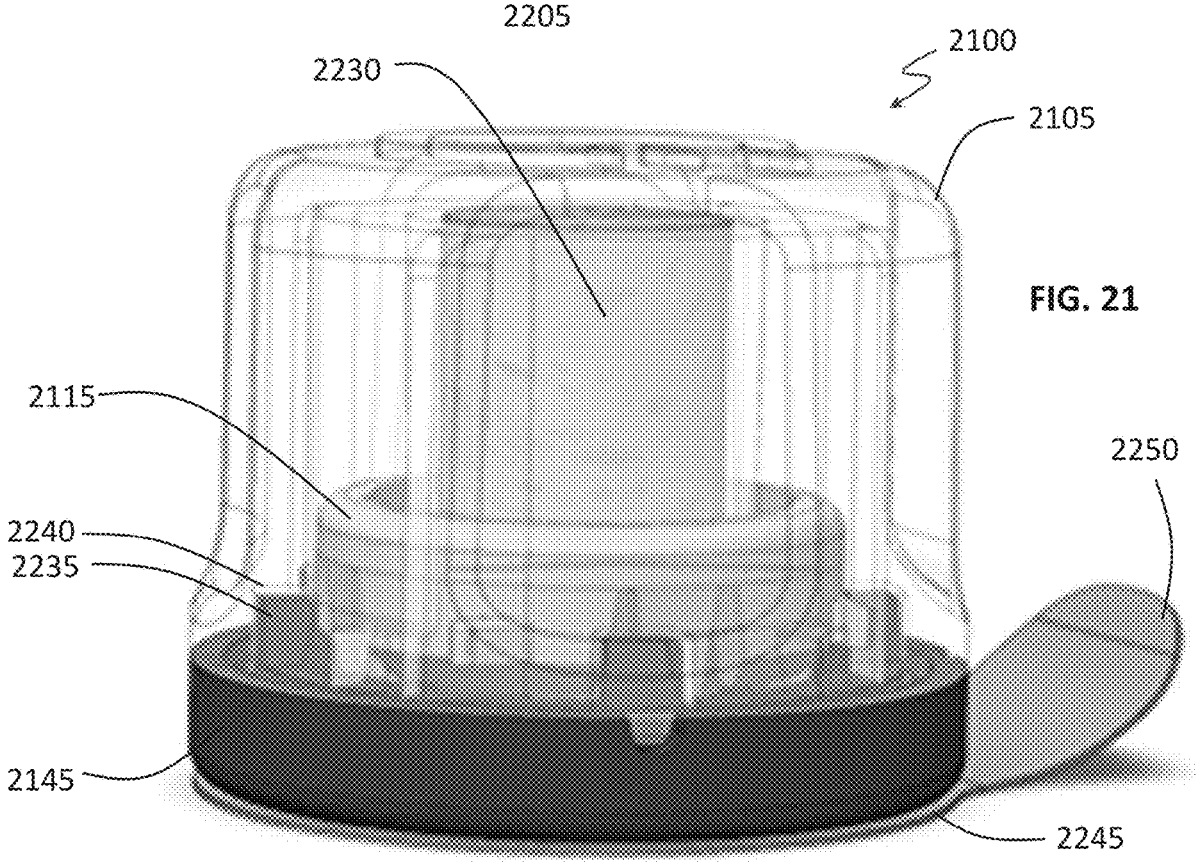
FIG. 21 illustrates an assembled view of the embodiment of the single use cap illustrated in FIGS. 20A-20C.

Turning now to FIG. 21, illustrated is an assembled view of the embodiment of the single use cap 2100 illustrated in FIGS. 20A-20C. With the cap body 2105 shown partially transparent, the threaded component 2115 is shown at the bottom of the cap body 2105, resting on the cap base 2145. Additionally, the plug or sponge 2230 can also be seen extending from the top of the interior of the cap body 2105 down through the center opening of the threaded component 2115. The plug 2230 is sized and shaped to fit into the upper opening of the receptacle (not illustrated) onto which the single use cap 2100 is threaded to provide a seal of the receptacle.

Locking tabs 2235 form on a top of and upwardly extending from the cap base 2145 may also be seen engaging with corresponding locking recesses 2240 formed into the bottom interior of the cap body 2105. These locking tabs 2235 and locking recesses 2240 cooperate to help secure the cap body 2105 onto the cap base 2145, with the threaded component 2115 movable therebetween. In some embodiments, these components may engage one another using a press fit or snap fit, and in other embodiments an adhesive may be provided between the two.

A removable seal 2245 is also visible affixed to the bottom of the cap base 2145 to keep the interior of the cap 2100 sterile or otherwise clean until ready for its single use on a receptacle or other structure. A pull tab 2250 extends from the seal 2245, which is graspable by a user to peal the seal 2245 off of the bottom of the cap base 2145 when the cap 2100 is ready for use. The seal 2245 may be formed from a film material and provides a hermetic seal to the interior of the cap body 2105. This sealing film 2245 feature is further used to maintain a "wet" environment internally to the cap, thus preventing drying of the sponge 2230. Such a seal and wet environment advantageously permits a sterilizing of the contact between the cap 2100 and a receptacle or other connector without the need to employ a separate sterilizing product, such as an alcohol wipe. For example, contaminants could be present on the neck and receiving end of a receptacle onto which the cap 2100 will be secured, and alcohol or other sterilizing agent on the peeled film 2245 may be used to remove such contaminant before the cap 2100 is threaded onto the receptacle.

Figure 22:
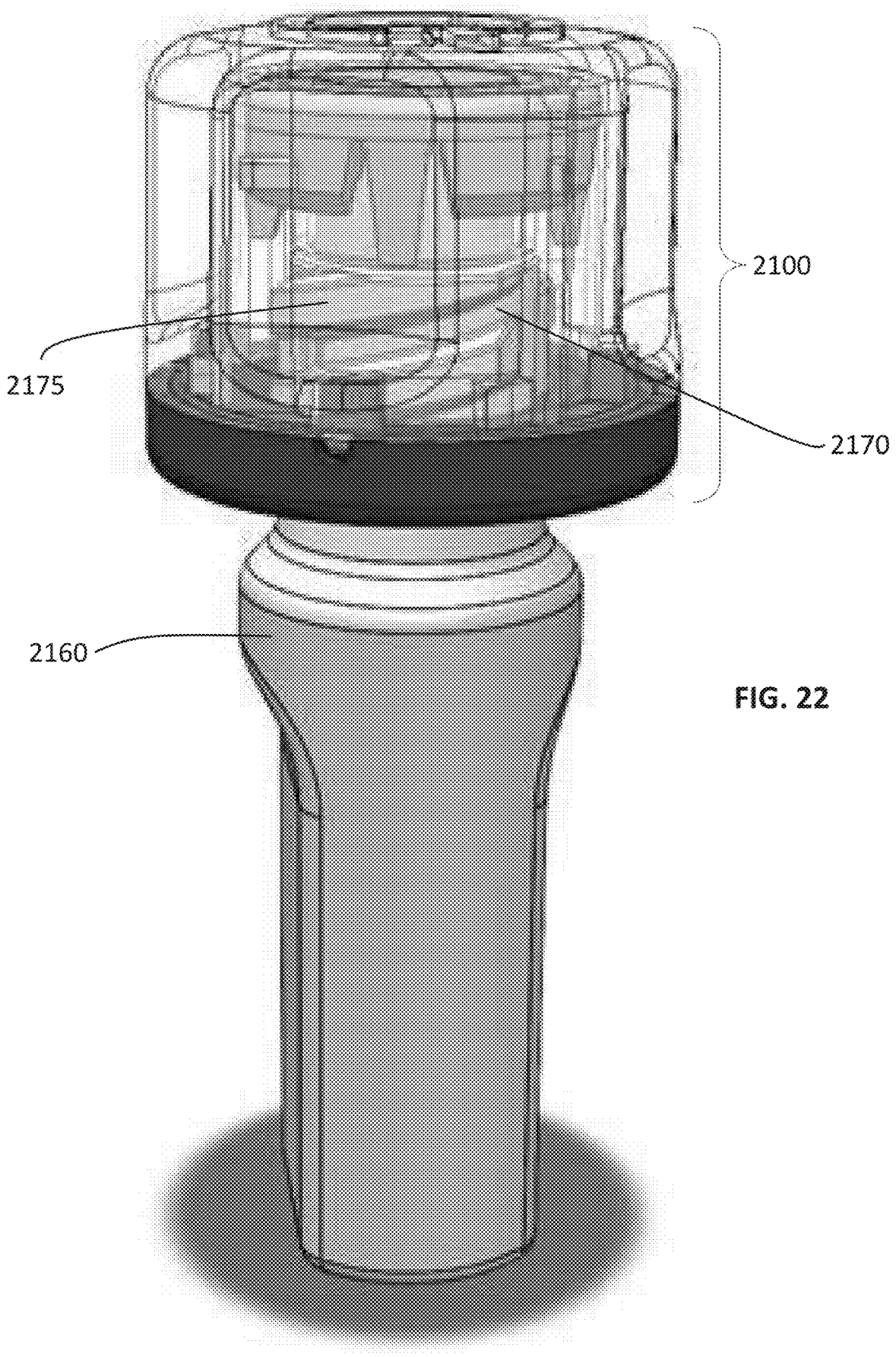
FIG. 22 illustrates the single use cap illustrated in FIG. 21 after it is threaded onto a receptacle.

FIG. 22 illustrates the single use cap illustrated in FIG. 21 in a used state as it is attempted to be threaded onto a receptacle, which in this embodiment is a needless connector 2160. Again the cap body 2105 is illustrated partially transparent, which permits easier viewing of the interior of the cap 2100. The neck 2170 of the receptacle 2160 may be seen passing up through the central opening of the cap base 2145. However, instead of the threads 2175 of the receptacle 2160 engaging the threads of the threaded component 2115, the threaded component 2115 is slid upward into the top of the cap body 2105 such that the threads 2175 of the receptacle 2160 cannot reach the threads of the threaded component 2115. By preventing this engagement of the threads, the used cap 2100 cannot be rethreaded onto the receptacle 2160.

Figures 23, 23A:
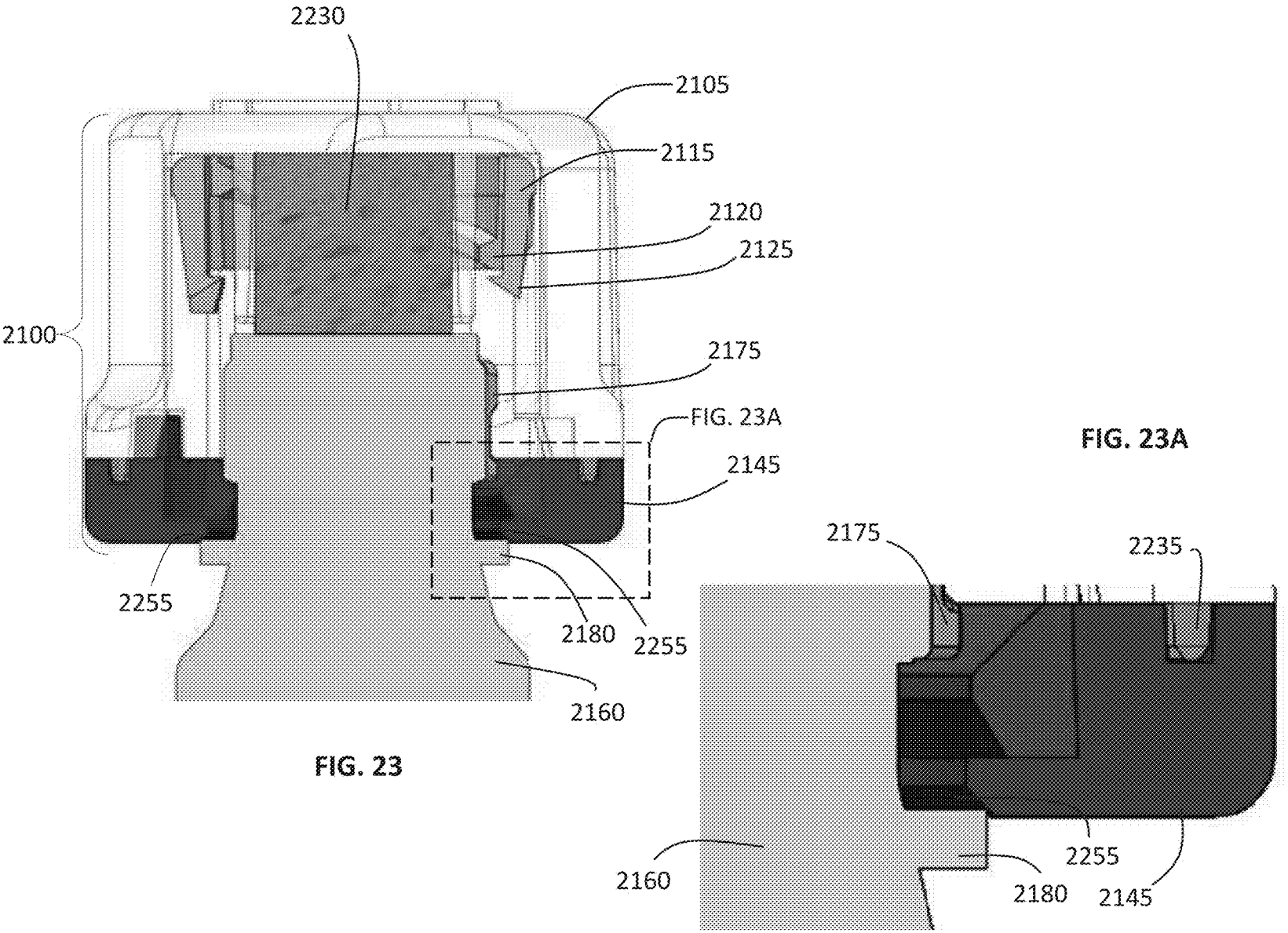
FIG. 23 illustrates a cross sectional view of the embodiment of the single use cap illustrated in FIG. 22.
FIG. 23A illustrates a close up view of a portion of the single use cap illustrated in FIG. 22.

Referring now to FIG. 23, illustrate is a cross sectional view of the embodiment of the single use cap 2100 illustrated in FIG. 22. Again the cap body 2105 is illustrated partially transparent, which permits easier viewing of the interior of the cap 2100. The neck 2170 of the receptacle 2160 may be seen positioned through the central opening of the cap base 2145. When the threads 2120 of the threaded component 2115 are engaged with the threads 2175 of the receptacle 2160, a seal between the cap 2100 and the receptacle 2160 in addition to the seal provided by the plug 2230 is provided. Specifically, an external lip 2255 formed around the central opening of the cap base 2145 is sized and shaped to press against a top edge or surface of a collar 2180 of the receptacle 2160 to provide this additional seal.

Looking finally at FIG. 23A, illustrated is a close up view of the seal area of the single use cap 2100 illustrated in FIG. 22. From this close up view, the lower seal lip 2255 of the cap base 2145 can be seen pressed against the top edge or surface of the collar 2180 formed around the neck of the receptacle 2160, which provides a hermetic seal so as to prevent not only contamination within the cap 2100 but also to prevent evaporation of liquids from within the connection between the cap 2100 and the receptacle 2160. Of course, a different feature may be formed on and around the receptacle 2160 to provide the sealing surface pressing against the sealing lip 2255.

While this disclosure has been particularly shown and described with reference to preferred embodiments, it will be understood by those skilled in the pertinent field art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this disclosure includes all modifications and equivalents of the subject matter recited in the claims appended hereto, as permitted by applicable law. Moreover, any combination of the above-described elements in all possible variations thereof is encompassed by the disclosure unless otherwise indicated herein or otherwise clearly contradicted by context.

Also, while various embodiments in accordance with the principles disclosed herein have been described above, it should be understood that they have been presented by way of example only, and not limitation. Thus, the breadth and scope of this disclosure should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

The uses of the terms "a" and "an" and "the" and similar references in the context of describing the invention(s) (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein.

Additionally, the section headings herein are provided for consistency with the suggestions under 37 C.F.R. 1.77 or otherwise to provide organizational cues. These headings shall not limit or characterize the invention(s) set out in any claims that may issue from this disclosure. Specifically, and by way of example, although the headings refer to a "Technical Field," the claims should not be limited by the language chosen under this heading to describe the so-called field. Further, a description of a technology as background information is not to be construed as an admission that certain technology is prior art to any embodiment(s) in this disclosure. Neither is the "Summary" to be considered as a characterization of the embodiment(s) set forth in issued claims. Furthermore, any reference in this disclosure to "invention" in the singular should not be used to argue that there is only a single point of novelty in this disclosure. Multiple embodiments may be set forth according to the limitations of the multiple claims issuing from this disclosure, and such claims accordingly define the embodiment(s), and their equivalents, that are protected thereby. In all instances, the scope of such claims shall be considered on their own merits in light of this disclosure, but should not be constrained by the headings set forth herein.

Moreover, the Abstract is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the claims reflect, inventive subject matter lies in less than all features of a single disclosed embodiment. Thus, the following claims are hereby incorporated into the Detailed Description, with each claim standing on its own as a separate embodiment.

Any and all publications, patents, and patent applications cited in this specification are herein incorporated by reference as if each individual publication, patent, or patent application were specifically and individually indicated to be incorporated by reference and set forth in its entirety herein.

What is claimed is:

1. A single use cap for a receptacle, the cap comprising:

a cap body having a top, a bottom, and a hollow interior therebetween accessible through an opening in the bottom of the cap body;

a cap base coupled at the bottom of the cap body and comprising an opening configured to receive a neck of the receptacle therethrough, wherein an interior face of the cap base is configured to be received within the opening of the cap body; and a threaded component configured to be movably received within the hollow interior, and comprising an opening with inwardly protruding threads, the threads configured to receive threads on the neck of the receptacle;

wherein when the threaded component is in an unused position, said threaded component is positioned proximate the bottom of the cap body such that the threads of the threaded component are reachable by the threads on the neck of the receptacle;

wherein when the threaded component is in a used position, said threaded component is prevented from rotating in either direction but freely movable vertically within the hollow interior of the cap body such that the threads of the threaded component are not reachable by the threads on the neck of the receptacle when a distal end of said neck contacts the threaded component.

2. The single use cap of claim 1, wherein the threaded component comprises one or more locking features each configured to engage a corresponding groove formed in the hollow interior of the cap body when the threaded component is in the unused position, said engagement with corresponding one or more grooves preventing the threaded component from rotating in a direction corresponding to a tightening rotational direction of the threads of the threaded component.

3. The single use cap of claim 2, further comprising one or more exterior cams located along a perimeter of the threaded component and corresponding one or more interior cams formed in the hollow interior of the cap body, wherein a top surface of each exterior cam engages a bottom surface of each corresponding interior cam to prevent vertical movement of the threaded component when in the unused position.

4. The single use cap of claim 3, wherein the one or more locking features are each further configured to engage a corresponding locking step formed in the hollow interior of the cap body when the threaded component is in the used position, said engagement with corresponding one or more locking steps preventing the threaded component from rotating in the direction corresponding to a tightening rotational direction of the threads of the threaded component.

5. The single use cap of claim 4, further comprising one or more backstop formed in the hollow interior of the cap body and corresponding to each of the one or more exterior cams, the one or more backstops configured to engage a sidewall of each corresponding exterior cam when the threaded component is in the used position, said engagement with the sidewall of the one or more exterior cams preventing the threaded component from rotating in a direction corresponding to a loosening rotational direction of the threads of the threaded component.

6. The single use cap of claim 5, wherein each of the one or more interior cams and corresponding one or more of said backstops are aligned to form cavities in the hollow interior of the cap body, each said cavities sized to receive a corresponding exterior cam therein to permit said vertical movement of the threaded component when in the used position.

7. The single use cap of claim 6, wherein the one or more locking features are configured to slide along the corresponding one or more locking steps during said permitted vertical movement of the threaded component.

8. The single use cap of claim 1, further comprising one or more flexible arms extending downwardly from a bottom of the threaded component, the one or more flexible arms configured to flex outwardly when the threaded component is in the unused position and the threads on the neck of the receptacle are received within the threaded component.

9. The single use cap of claim 8, wherein the one or more flexible arms are further configured to contact a top surface of the neck of the receptacle without flexing outwardly when the threaded component is in the used position, said contact causing vertical movement of the threaded component within the hollow interior of the cap body.

10. The single use cap of claim 1, wherein one or more of the cap body, cap base, and threaded component are constructed from a plastic material.

11. A single use cap for a receptacle, the cap comprising:

a cap body having a top, a bottom, and a hollow interior therebetween accessible through an opening in the bottom of the cap body;

a cap base coupled at the bottom of the cap body and comprising an opening therethrough about an axis of rotation of the cap base; and a threaded component configured to be movably received within the hollow interior, and comprising an opening with inwardly protruding threads concentric with the opening of the cap base, the threads configured to receive threads on a neck of the receptacle;

wherein the threaded component is configured to rotate with respect to the cap base about the axis of rotation from an unused position, where the threads of the threaded component are reachable by the threads on the neck of the receptacle, to a used position, where the threaded component is freely movable vertically within the cap body such that the threads of the threaded component are not reachable by the threads on the neck of the receptacle when a distal end of said neck contacts the threaded component;

wherein the threaded component comprises one or more features, each configured to:

prevent rotation of the threaded component in a direction corresponding to a tightening rotational direction of the threads of the threaded component when the threaded component is in the unused position; and prevent rotation of the threaded component in either the direction corresponding to a tightening rotational direction of the threads of the threaded component or a loosening rotational direction of the threads of the threaded component when the threaded component is in the used position.

12. The single use cap of claim 11, wherein the one or more features comprise one or more locking features each configured to engage a corresponding groove formed in the hollow interior of the cap body when the threaded component is in the unused position, said engagement with corresponding one or more grooves preventing the threaded component from rotating in the direction corresponding to a tightening rotational direction of the threads of the threaded component.

13. The single use cap of claim 12, wherein the one or more locking features are each further configured to engage a corresponding locking step formed in the hollow interior of the cap body when the threaded component is in the used position, said engagement with corresponding one or more locking steps preventing the threaded component from rotating in the direction corresponding to a tightening rotational direction of the threads of the threaded component.

14. The single use cap of claim 13, wherein the one or more features comprise a plurality of features, and wherein the plurality of features further comprise one or more exterior cams located along a perimeter of the threaded component and corresponding one or more interior cams formed in the hollow interior of the cap body, wherein a top surface of each exterior cam engages a bottom surface of each corresponding interior cam to prevent vertical movement of the threaded component when in the unused position.

15. The single use cap of claim 14, the plurality of features further comprising one or more backstop formed in the hollow interior of the cap body and corresponding to each of the one or more exterior cams, the one or more backstops configured to engage a sidewall of each corresponding exterior cam when the threaded component is in the used position, said engagement with the sidewall of the one or more exterior cams preventing the threaded component from rotating in the direction corresponding to a loosening rotational direction of the threads of the threaded component.

16. The single use cap of claim 15, wherein each of the one or more interior cams and corresponding one or more of said backstops are aligned to form cavities in the hollow interior of the cap body, each said cavities sized to receive a corresponding exterior cam therein to permit said vertical movement of the threaded component when in the used position.

17. The single use cap of claim 16, wherein the one or more locking features are configured to slide along the corresponding one or more locking steps during said vertical movement of the threaded component.

18. The single use cap of claim 1, further comprising one or more flexible arms extending downwardly from a bottom of the threaded component, the one or more flexible arms configured to flex outwardly when the threaded component is in the unused position and the threads on the neck of the receptacle are received within the threaded component.

19. The single use cap of claim 18, wherein the one or more flexible arms are further configured to contact a top surface of the neck of the receptacle without flexing outwardly when the threaded component is in the used position, said contact causing vertical movement of the threaded component within the hollow interior of the cap body.

20. The single use cap of claim 11, wherein one or more of the cap body, cap base, and threaded component are constructed from a plastic material.

* * * * *